US009204519B2

(12) United States Patent
Gan et al.

(10) Patent No.: US 9,204,519 B2
(45) Date of Patent: Dec. 1, 2015

(54) CONTROL SYSTEM WITH USER INTERFACE FOR LIGHTING FIXTURES

(71) Applicant: PQJ CORP, Santa Clarita, CA (US)

(72) Inventors: Quan Gan, Santa Calarita, CA (US); Jun Dong, Pudong (CN)

(73) Assignee: PQJ CORP, Valencia, CA (US)

( * ) Notice: Subject to any disclaimer, the term of this patent is extended or adjusted under 35 U.S.C. 154(b) by 103 days.

(21) Appl. No.: 13/775,061

(22) Filed: Feb. 22, 2013

(65) Prior Publication Data

US 2013/0221872 A1 Aug. 29, 2013

Related U.S. Application Data

(60) Provisional application No. 61/603,242, filed on Feb. 25, 2012.

(51) Int. Cl.
*H05B 37/02* (2006.01)

(52) U.S. Cl.
CPC ..... *H05B 37/02* (2013.01); *H05B 37/0254* (2013.01)

(58) Field of Classification Search
None
See application file for complete search history.

(56) References Cited

U.S. PATENT DOCUMENTS 5,769,527 A * 6/1998 Taylor ..... G05B 19/0421 315/316
6,016,038 A 1/2000 Mueller et al.
6,150,774 A 11/2000 Mueller et al.
6,175,201 B1 1/2001 Sid
6,815,842 B2 * 11/2004 Fehd ..... H05B 33/08 307/40
6,967,448 B2 11/2005 Morgan et al.
7,228,190 B2 6/2007 Dowling et al.
7,332,877 B2 * 2/2008 Crodian ..... B60Q 1/1423 315/292
7,427,840 B2 * 9/2008 Morgan ..... F21V 33/004 315/295
7,450,085 B2 11/2008 Thielemans et al.
7,868,562 B2 1/2011 Salsbury et al.
7,994,732 B2 8/2011 Zulch
8,035,320 B2 10/2011 Sibert
8,115,407 B2 2/2012 Chang et al.
8,299,721 B2 * 10/2012 Smith ..... H05B 37/0245 315/291
8,386,266 B2 2/2013 Feng et al.
8,573,487 B2 11/2013 McKelvey
8,589,908 B2 * 11/2013 Subbakrishna ..... G06F 8/65 711/142
8,661,429 B2 * 2/2014 Ruster ..... G06F 8/65 717/173
2002/0007510 A1 * 1/2002 Mann ..... E03C 1/057 4/300
2004/0212309 A1 * 10/2004 St.-Germain ..... B61L 5/1881 315/76
2005/0070153 A1 3/2005 Tang
2008/0136334 A1 * 6/2008 Robinson ..... H05B 37/0254 315/151
2009/0024865 A1 1/2009 Fugaro et al.
2009/0085500 A1 * 4/2009 Zampini, II ..... H05B 33/0857 315/297
2009/0219305 A1 9/2009 Diederiks et al.
2011/0109228 A1 5/2011 Shimomura et al.

(Continued)

OTHER PUBLICATIONS

Color Kinetics, Philips; ZAP1 1.5 Brouchure 2005; http://colorkinetics.com/patents/.

(Continued)

*Primary Examiner* — Tung X Le
*Assistant Examiner* — Srinivas Sathiraju
(74) *Attorney, Agent, or Firm* — Patent Law Agency, LLC; Peter Ganjian

(57) ABSTRACT

The present invention discloses a control system, comprising user interface that includes an input/output module for assignment of address and control configurations for a fixture; and uses a light for outputting a precise indication and feedback confirmation of exact settings for address and control configurations.

25 Claims, 16 Drawing Sheets

(56) References Cited

U.S. PATENT DOCUMENTS

| | | | | |
|---|---|---|---|---|
| 2011/0131356 | A1 | 6/2011 | Devam et al. | |
| 2011/0137757 | A1 | 6/2011 | Paolini et al. | |
| 2011/0144778 | A1 | 6/2011 | Fung et al. | |
| 2011/0153885 | A1 | 6/2011 | Mak et al. | |
| 2011/0234119 | A1 | 9/2011 | Zulch | |
| 2012/0008851 | A1 | 1/2012 | Pennock et al. | |
| 2012/0013255 | A1 | 1/2012 | Young | |
| 2012/0026019 | A1 | 2/2012 | Lin et al. | |
| 2012/0086345 | A1* | 4/2012 | Tran | H05B 37/0272 315/158 |
| 2012/0126722 | A1 | 5/2012 | Archdale | |
| 2012/0169249 | A1 | 7/2012 | Loveland et al. | |
| 2012/0231837 | A1 | 9/2012 | Hilbrink et al. | |
| 2012/0236160 | A1 | 9/2012 | Rezek et al. | |
| 2012/0290742 | A1 | 11/2012 | Sun et al. | |
| 2013/0018240 | A1 | 1/2013 | McCoy | |
| 2013/0073058 | A1* | 3/2013 | Wei | H05B 33/0842 700/11 |
| 2013/0130743 | A1 | 5/2013 | Lin | |
| 2013/0134891 | A1 | 5/2013 | Woytowitz | |
| 2013/0147367 | A1 | 6/2013 | Cowburn | |
| 2013/0207481 | A1 | 8/2013 | Gobburu et al. | |
| 2013/0221872 | A1* | 8/2013 | Gan | H05B 37/0254 315/292 |
| 2013/0249429 | A1 | 9/2013 | Woytowitz et al. | |
| 2013/0264943 | A1 | 10/2013 | Bora et al. | |
| 2013/0271004 | A1 | 10/2013 | Min et al. | |

OTHER PUBLICATIONS http://www.ronex.ee/; image of a conventional 3.5 mm stereo plug to 39 screw terminal—DC Connector and plug.

ENTTEC control products ;—open DMX ethernet ODE ; www.enttec.com; 2013.

Luminair for iOS Digital Lighting control for iPad, iPhone, ; http://synthe-fx.com/products/luminair; 2008.

Microchip PIC12(L)F1822/PIC16(L)F1823 Data Sheet—2010.

www.beyondlogic.org ; USB in a NutShell—Chapter 2—Hardware ; Sep. 17, 2010.

PCT/US2015/022570 ; Filing Date: 25 Mar. 25, 2015; International Search and the Written Opinion; Jun. 16, 2015.

* cited by examiner

CONTROL SYSTEM WITH USER INTERFACE FOR LIGHTING FIXTURES

CROSS-REFERENCE TO RELATED APPLICATIONS

This application claims the benefit of priority of the U.S. Utility Provisional Patent Application No. 61/603,242, filed 25 Feb. 2012, the entire disclosure of which is expressly incorporated by reference herein. Where a definition or use of a term in an incorporated reference is inconsistent or contrary to the definition of that term provided herein, the definition of that term provided herein applies and the definition of that term in the reference does not apply.

BACKGROUND OF THE INVENTION

1. Field of the Invention

This invention relates to control systems for fixtures and, more particularly to a user interface that includes an input mechanism that enables assignment of address and control configurations of a fixture, and enables the fixture itself to output a precise indication of the various exact settings (address and or control configurations).

2. Description of Related Art

Conventional larger lighting fixtures have sufficient bulk or mass to accommodate on the fixtures itself an onboard addressing circuit with an user interface such as a Dual Inline Package (DIP) switch or buttons and displays, which are extensively used to identify the particular channel or channels from which the fixture will take instructions from a communications and control protocol such as the well known Digital Multiplexer (DMX-512) protocol.

Although smaller conventional lighting fixtures (e.g., with dimensions smaller than a size of a human index finger) do exists, they cannot and do not have an onboard addressing circuit such as DIP switches or buttons and displays due to their small size. A fixture without a means to address it (to communicate desired modulations) is generally known as a non-intelligent fixture because it has no means of being specifically addressed for control in terms of assigned configurations. External addressable control devices exist that may be used and connected to the smaller conventional non-intelligent lighting fixtures to provide the needed control for modulating the smaller conventional non-intelligent light fixtures as needed. However, the use of external addressable control device (which are mostly large and bulky) is another additional large equipment that takes on space, requires installation, and adds more complexity in terms of wiring (signal and power lines). It should be noted that external addressable control devices, as with larger lighting fixture mentioned above, are large and as a result of their bulk accommodate an onboard addressing circuit with an user interface such as DIP switches or buttons and displays.

Unfortunately, regardless of the type of addressing device used (i.e., DIP switches, buttons and displays, or external addressable control devices), the setting, modifying, or debugging of addresses and control configurations using such devices is very complex when considering setting, modifying, or debugging of an address and control configuration of even one fixture. The complexity is substantially compounded when considering an entire set of theatrical fixtures that may encompass hundreds of such fixtures, with each requiring addressing and control configurations (whether using DIP switches, buttons and displays, or external addressable control devices with similar user interfaces).

Accordingly, in light of the current state of the art and the drawbacks to current light fixtures and controllers and the required addressing schemes, a need exists for a compact control system that would provide a user interface for setting, modifying, and debugging of addresses and control configurations of even small sized lighting fixtures and controllers, and that would also precisely indicate the various exact settings (address and or control configurations) of the lighting fixture and controllers.

BRIEF SUMMARY OF THE INVENTION

A non-limiting, exemplary aspect of an embodiment of the present invention provides a lighting fixture, comprising:

integrated control system:

the integrated control system includes a user interface that has an input for assignment of address and control configurations, with the integrated control system using light modulations from the lighting fixture as an output for confirmation of the assigned address and control configurations.

Another non-limiting, exemplary aspect of an embodiment of the present invention provides a lighting fixture, comprising:

an intelligent micro-spotlight that includes:

one or more light sources;

a control circuit for receiving signals;

a coupler comprised of a first and a second couplers and coupled with the light source and the control circuit for delivery of power and signals to the light source and the control circuit of the intelligent micro-spotlight; and the intelligent micro-spotlight providing confirmation of received signals using the one or more light sources.

Still another non-limiting, exemplary aspect of an embodiment of the present invention provides a control system, comprising:

programming device for configuring an external device;

the programming device includes:

a user interface comprised of:

an input and output module;

the input module for inputting values for desired configuration of the external device;

an output module for displaying information for settings and configurations for the external device;

a Central Processing Unit that is powered by a voltage regulator and receives input from the input module and displays processed signals to the output module and a signal transmitter.

A further, non-limiting, exemplary aspect of an embodiment of the present invention provides a method for processing control signals, comprising:

retrieving stored address data related to start address of light source;

outputting retrieved address data to operate light source in accordance with address attributes;

retrieving stored data related to attributes of mode of operation of light source;

outputting retrieved data to operate light source in accordance with attributes associated with the mode of operation; and determining if an incoming signal is received.

Still a further, non-limiting, exemplary aspect of an embodiment of the present invention provides a method for processing control signals, comprising:

loading stored data to memory;

loading current mode onto user interface;

determining if address mode or control mode is selected;

if address mode, inputting and displaying selected address;

determining the receipt of confirmation signal of the selected address;

if confirmation of address is received, forwarding a manufacturer's code encoded with address mode code with the set address and storing the set address to a storage module.

Another non-limiting, exemplary aspect of an embodiment of the present invention provides a control system, comprising:

user interface that includes:

an input mechanism for assignment of address and control configurations for a lighting fixture; and an output mechanism that uses the lighting fixture for outputting a precise indication of exact settings for address and control configurations.

Still another non-limiting, exemplary aspect of an embodiment of the present invention provides a control system, comprising:

user interface that includes:

an input mechanism for assignment of address and control configurations for a lighting fixture; and an intermediary module that uses the lighting fixture and built-in light sources as an output mechanism for outputting a precise indication of exact settings for address and control configurations.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

Figure 1A:
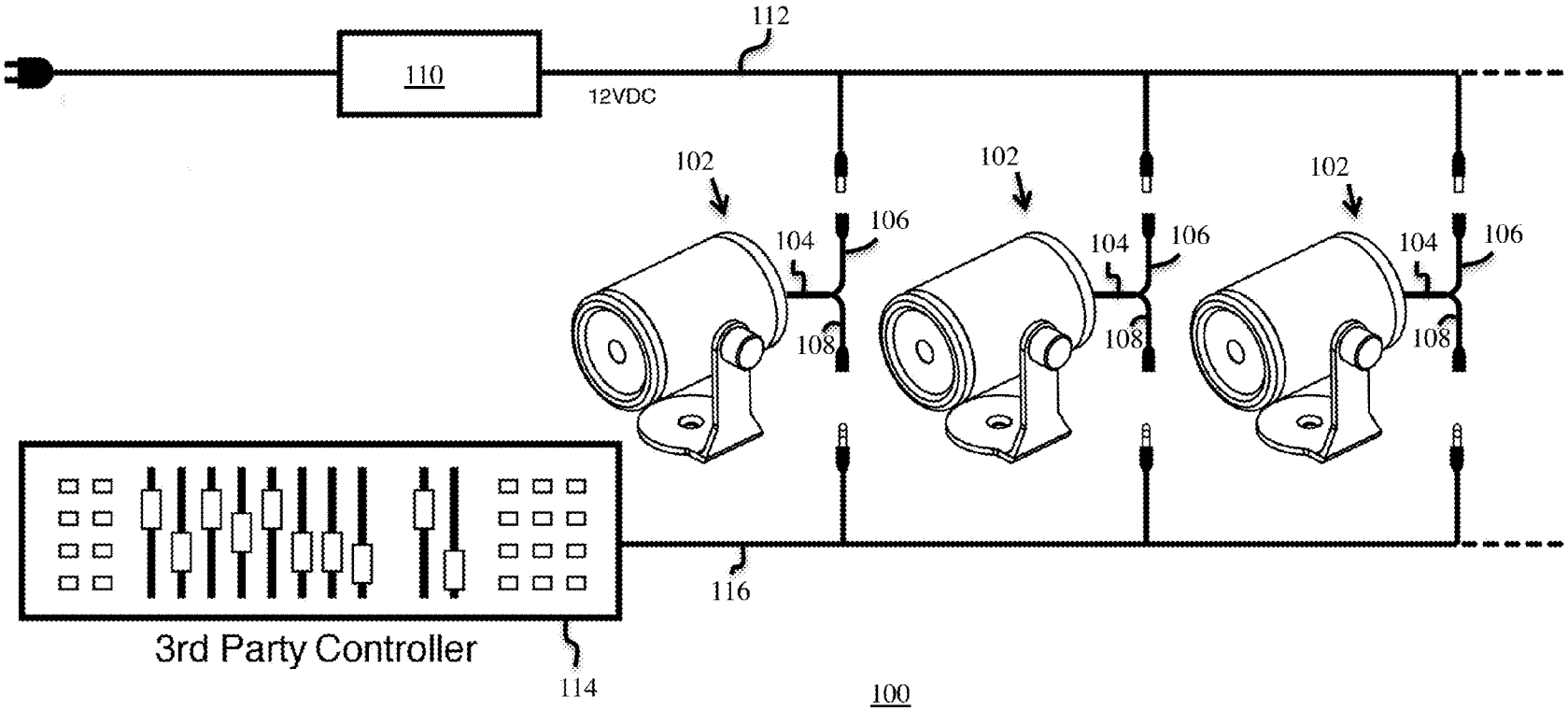
FIG. 1A is a non-limiting, exemplary system overview illustration of an already fully configured and installed set of intelligent micro-spotlights in operation in accordance with an embodiment of the present invention.

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart may represent both method function(s), operation(s), or act(s) and one or more elements for performing the method function(s), operation(s), or act(s). In addition, depending upon the implementation, the corresponding one or more elements may be configured in hardware, software, firmware, or combinations thereof.

In the description given below and the corresponding set of drawing figures, when it is necessary to distinguish the various members, elements, sections/portions, components, or any other aspects (functional or otherwise) or features of a device(s) or method(s) from each other, the description and the corresponding drawing figures will follow reference numbers with a small alphabet character such as (for example) "intelligent micro-spotlight 102*a*, 102*b*, etc." If the description is common to all of the various members, elements, sections/portions, components, or any other aspects (functional or otherwise) or features of a device (s) or method(s) such as (for example) to all intelligent micro-spotlights 102*a*, 102*b*, etc., then they are simply referred to with reference number only and with no alphabet character such as (for example) "intelligent micro-spotlight 102."

Throughout the disclosure, references to theatrical fixtures (or lighting fixtures) are meant as illustrative and for convenience of example, only. That is, the use of the control system and fixtures of the present invention should not be limited to theater but may also be used in any space or environment that requires controllable fixtures.

The present invention may use and allocate address and control configurations for various devices and their modes of operations using any number of protocols, a non-limiting example of which may include the well known DMX512 protocol. The devices disclosed throughout the disclosure in accordance with the various embodiments of the present invention using such protocols encompass a vast variety of different modes of operations defined by attributes (or parameters or properties) that can be modulated based on predetermined values assigned to the attributes. Each attribute (e.g., color of light, intensity of light, combinations of colors of lights, flicker, blink, and many others) may be physically implemented (or associated) and mapped with one or more of the 512 DMX channels (if DMX protocol is used) or, alternatively, mapped using other protocols. Accordingly, the use of DMX512 protocol throughout the disclosure should not be limiting and is meant as illustrative and for convenience of example, only.

The conventional methods for addressing a fixture using the DMX512 protocol typically require physical components with minimal circuit board footprint of about 1 inch by 0.5 inches. While the conventional methods are suitable for traditional lighting and effects fixtures that have room for larger circuit components, the trend of product miniaturization in accordance with the present invention requires a new method of address and configuration selection without the need of DIP switches or buttons and displays. The methods disclosed below are means of address and configuration selection using an external programmer, with a user interface, connected to the fixture and a means of visual feedback on the programmed fixture using only a pulsating sequence of light emitting diodes (LEDs). The fixture in accordance with the present invention can use a lower pin count microprocessor and requires no physical space for buttons or displays, thus allowing for product miniaturization.

It should be noted that it is only for clarity and better understanding that the storage modules or memories of the various devices disclosed and illustrated throughout the disclosure are exemplarily shown as being outside a Central Processing Unit (CPU), but may actually reside inside the CPU.

One or more embodiments of the present invention provide a compact control system that have a user interface for setting, modifying, and debugging of addresses and or control configurations of fixtures, including precisely indicating the various exact settings (address and or control configurations) of the fixture.

At least one embodiment of the present invention provides an user interface that includes an input mechanism that enables assignment of address and control configurations of a fixture, and has the fixture itself as the output mechanism to output a precise indication of the various exact settings (address and or control configurations). That is, the light from the lighting fixture itself is used as the output portion of the user interface to provide a visual indication as a confirmation feedback response of the assigned address and or configurations. This means that the lighting fixture itself conveys an output response in terms of the set address and control configurations received, providing a visual response confirmation of the exact address and control configurations.

At least one embodiment of the present invention provides an user interface that includes an input mechanism that enables assignment of address and control configurations of a fixture, and enables an intermediary module and or a fixture itself output a precise indication of the various exact settings (address and or control configurations). That is, the light from the intermediary module and or lighting fixture itself is used to provide a visual indication as a confirmation feedback response of the assigned address and or configurations. This means that the intermediary module and or lighting fixture itself conveys a response in terms of the set address and control configurations received, providing a visual response confirmation of the exact address and control configurations.

The present invention provides a user interface (input and output) that is understandable by human intellect and human senses for interaction. A non-limiting example of a user interface may include using the light fixture itself to provide a visual indicator to allow a visual way of interacting with the control system. The disclosed user interface provided throughout the disclosure (e.g., the input portion of the user interface) is meant to be illustrative and for convenience of example only and should not be limiting. Therefore, the present invention is not limited to any particular input or output user interface configuration and may be implemented in a vast variety of different types of input/output user interfaces. Accordingly, the non-limiting, non-exhaustive illustrations of the user interfaces (e.g., input buttons, output display screens, etc.) used throughout the disclosure are provided as examples and only for a framework for discussion.

FIG. 1A is a non-limiting, exemplary system overview illustration of an already fully configured and installed set of intelligent micro-spotlights in operation in accordance with an embodiment of the present invention. In the illustration shown in FIG. 1A, the illustrated intelligent micro-spotlights 102 have been fully configured (programmed) so that the intelligent micro-spotlights 102 receive required power from the line 112 (which is coupled to a power source such as a wall outlet) via a DC regulator 110, and may optionally be coupled with and respond to any third party controller signal via the signal line 116 from a third party controller console 114 (e.g., a DMX controller). That is, the intelligent micro-spotlights 102 once programmed, need not be coupled with any third party controller console 114 to receive control signals via signal line 116 and may operate in standalone mode of operation. In other words, once the intelligent micro-spotlights 102 is fully programmed with address and desired configurations (detailed below), the intelligent micro-spotlights 102 may simply be directly coupled to power with no need or requirement for any signal line 116 connections. Thereafter, once powered, the intelligent micro-spotlights 102 output its default (or preprogrammed) configuration after its start address pulsing sequence (assuming a DMX controller scheme is used to program the intelligent micro-spotlights 102). It should be noted that while operating in standalone mode, the intelligent micro-spotlights 102 continues to actively "listen" to its signal (e.g., DMX) input port (detailed below) so that any incoming signal will override the default (or preprogrammed) output. Therefore, even if preprogrammed, if the intelligent micro-spotlights 102 is coupled with the signal line 116 of a control console 114 to receive signal, the intelligent micro-spotlights 102 will modulate light in accordance with the newly received incoming signal from the signal line 116, overriding the preprogrammed light modulation scheme.

As illustrated in FIG. 1A, due to their very small size, intelligent micro-spotlights 102 may be used in any spaced constrained application (especially in standalone operation not requiring any signal lines), including residential setting to shed controlled light that is modulated to any desired configuration onto a small painting or in a small, hidden location, underneath a small display in a retail store or even on a stage, with the controlled light from the intelligent micro-spotlight 102 only to be noticed after the intelligent micro-spotlight 102 is illuminated while the intelligent micro-spotlight 102 itself continues to remain inconspicuous within a small, confined space, all including the full capabilities of larger, bulkier conventional lighting fixtures but without the fixtures itself having an onboard addressing circuit such as a DIP switch or buttons and display. As another example, the intelligent micro-spotlight 102 may generate a controlled small spotlight (known in the industry as "pin spotting") with desired modulation that barely covers a small portion of a jewelry on a display of a retail store or a small prop on a stage or illuminates a small crevasse while remaining inconspicuous within a very small confined space, none of which are possible with larger, bulky, conventional lighting fixtures having an onboard conventional addressing circuit, not to mention the heat dissipation requirements of a large conventional lighting fixture when used in a small, constrained space.

In general, the intelligent micro-spotlight 102 in accordance with the present invention is a compact, low voltage, controllable Light Emitting Diode (LED) fixture that can be connected to any third party DMX console 114 or be programmed to run standalone (detailed below). The intelligent micro-spotlight 102 offers one or more colors of high intensity output in a small form factor. Most conventional lighting fixtures generate lights that are not homogenized. This mainly applies to multi-color lighting fixtures where a non-homogenized light beam looks blurry and is an uneven distribution of colors when the light is projected onto a surface. For example, on a red, green, blue fixture, when all 3 channels are ON, ideally one would have white, however conventional non-homogenized lights still reveal the three colors on the edges of the projection. This happens because there is overall a large light emitting surface (usually composed of an array of different colored lights). Because the different colors are emitted from slightly different parts of the array (instead of all light coming from a single point, on the same axis) the colors reach the projecting surface at different angles and different places. This is even more noticeable when an object is placed in front of the non-homogenous light source-generating multi-colored shadows projected onto the object because different colors impinge the object at different angles. The advantage of the ultra-compact, intelligent micro-spotlight light fixture of the present invention is that it has a significantly reduced overall light emitting surface area. The intelligent micro-spotlight 102 uses a well known single LED package with multiple diodes, causing the different colors lights to be emitted from relatively the same position and angle.

Figure 1B:
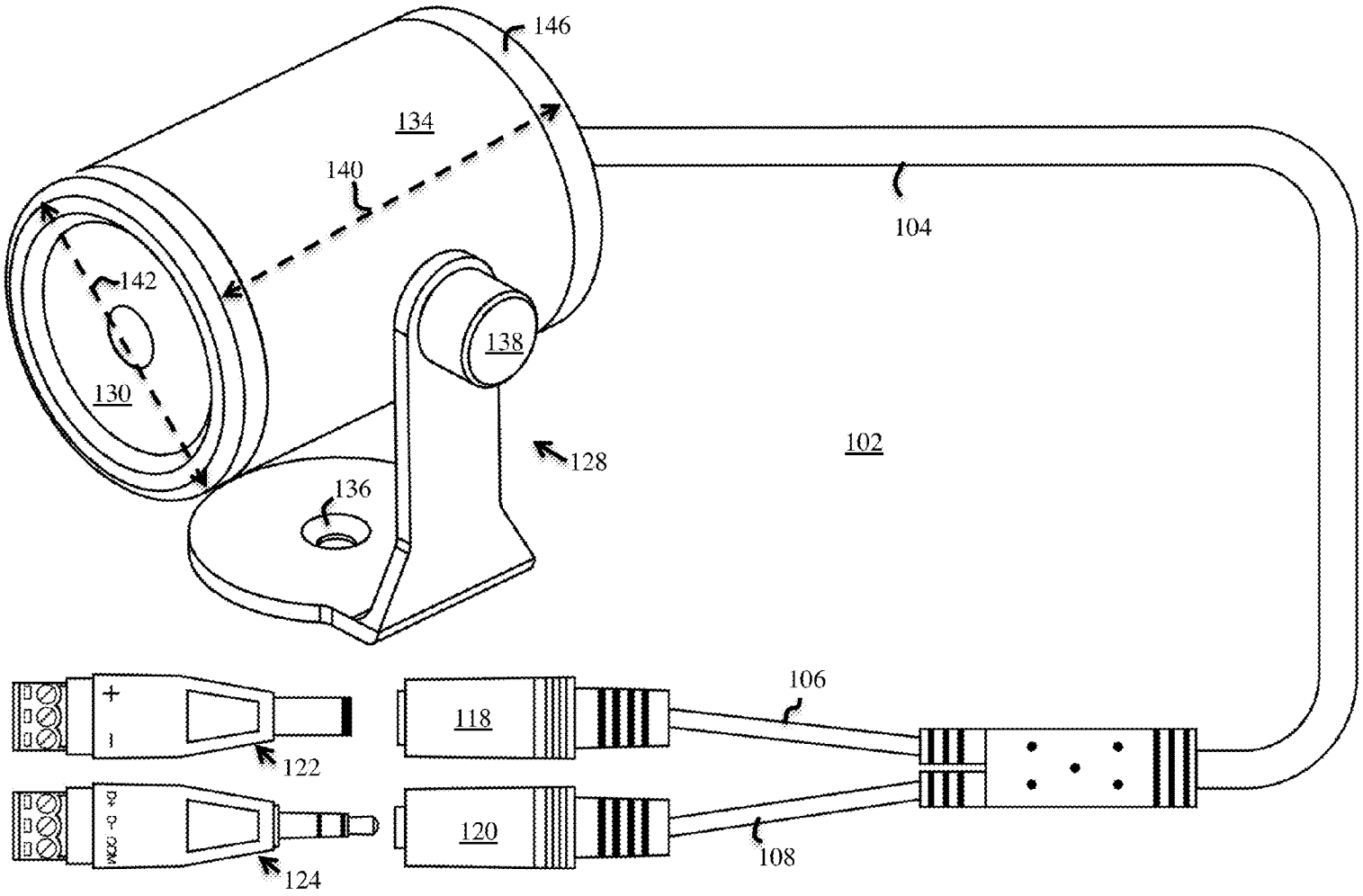
FIG. 1B is a non-limiting, exemplary illustration detailing exterior form factor of an intelligent micro-spotlight lighting fixture in accordance with an embodiment of the present invention.

FIG. 1B is a non-limiting, exemplary illustration detailing exterior form factor of an intelligent micro-spotlight lighting fixture in accordance with an embodiment of the present invention. As illustrated and stated above, the intelligent micro-spotlight 102 in accordance with the present invention is small and compact, longitudinally having a length 140 of about 2 inches with a diameter 130 of about 1.5 inches.

The intelligent micro-spotlight 102 includes a light source and an integrated control circuit that has all the intelligence to power and operate (or modulate) the light source. The intelligent micro-spotlight 102 includes a cable 104 comprised of a power cable 106 and signal cable 108 coupled with the control circuit 216 for delivery of power (via 106) and signals (via 108) to the intelligent micro-spotlight 102, with the intelligent micro-spotlight 102 providing confirmation feedback responses of received power and signals using its own light source.

Figure 1C:
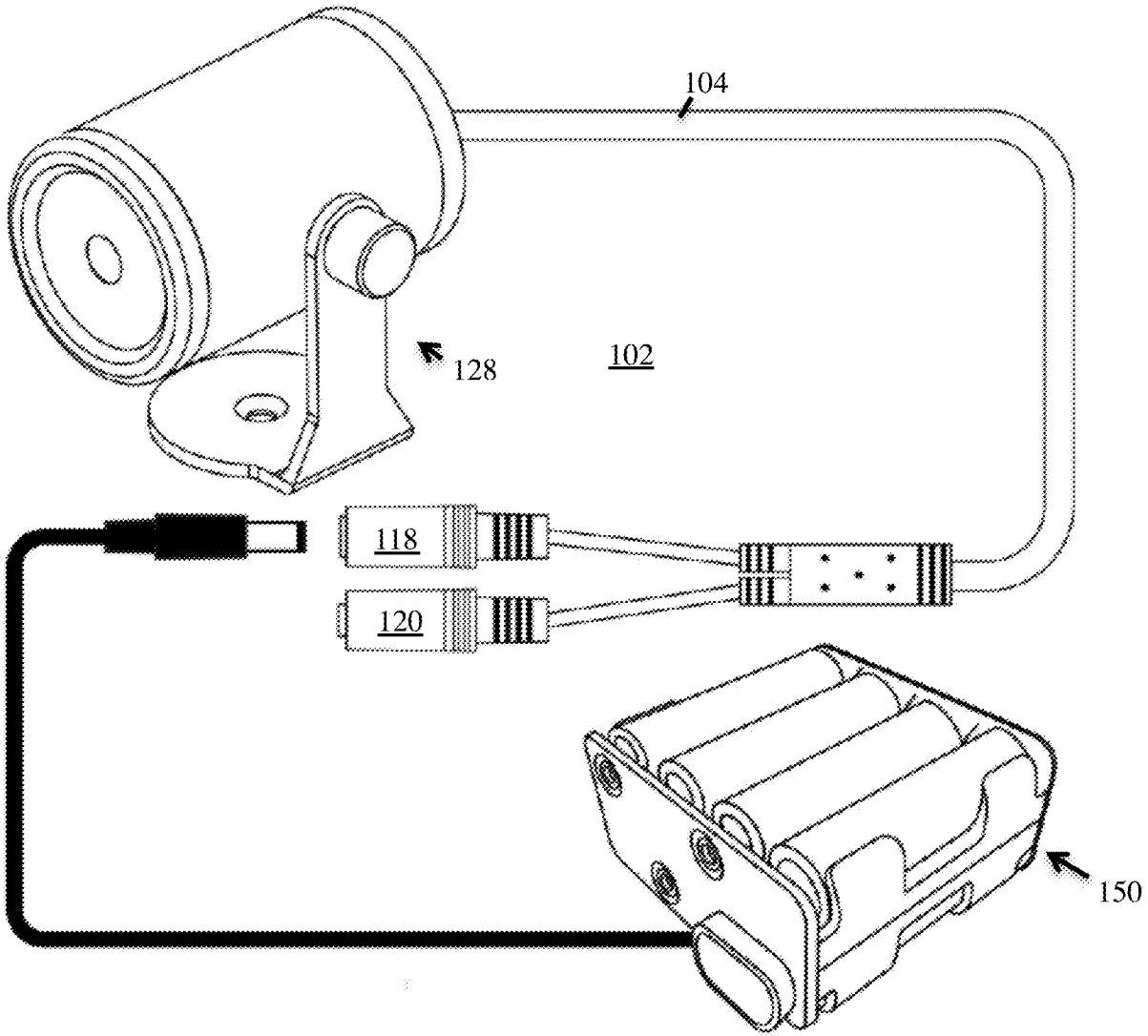
FIG. 1C is a non-limiting, exemplary illustration of an intelligent micro-spotlight lighting fixture powered by a battery pack in accordance with an embodiment of the present invention

The power cable 106 includes a power plug 118 for receiving power, and the signal cable 108 includes a signal plug 120 for receiving signals, both of which plugs 118 and 120 allow for quick and easy connections to respective power and signal sources. The signal plug 120 is a female Tip Ring Sleeve (TRS) connector (detailed below) used by the present invention for communication and processing of DMX signals. The power plug 118 is a female DC jack connector used by the present invention to receive power. It should be noted that the intelligent micro-spotlight 102 may be battery operated (as illustrated in FIG. 1C), coupled with (plugged to) a battery pack 150 via the illustrated standard power jack for providing the required power for operation and therefore, may be portable for mobile applications or event lightings where access to a wall outlet is not available or convenient.

As further illustrated in FIG. 1B, optionally, the power plug 118 may be coupled with a power source via an optional power plug adapter 122 for bare wire connection splicing, and optionally, the signal plug 120 may be coupled with a signal source via an optional signal plug adapter 124 for bare wire connection splicing. In the illustrated non-limiting, exemplary instance shown in FIG. 1B, the optional power plug adapter 122 is a DC jack to screw terminal adapter, and the signal plug adapter 124 is a Tip Ring Sleeve (TRS) signal to screw terminal adapter.

Due to the compact nature of the intelligent micro-spotlight 102, traditional XLR and power connectors (which are very bulky—almost larger than the light fixture 102) are not used. Instead, signal is connected using a non-limiting, exemplary illustrated $1/8^{th}$ inch (3.5 mm) TRS jack (same form factor as common stereo audio plugs) and power is connected using 2.1 mm standard DC jack (commonly found in security camera installations). Each of these jacks (120 and 118) may optionally be fitted with a screw terminal adapter (124 and 122) that allows the user to connect fixtures 102 together using bare wire. The use of such power and signal connectors (118 and 120) and adapters (122 and 124) allows the user to install the intelligent micro-spotlight 102 quickly and "temporarily" (without the adapters 122 and 124) or "permanently" (with the adapters 122 and 124) depending on the application.

Figure 2A:
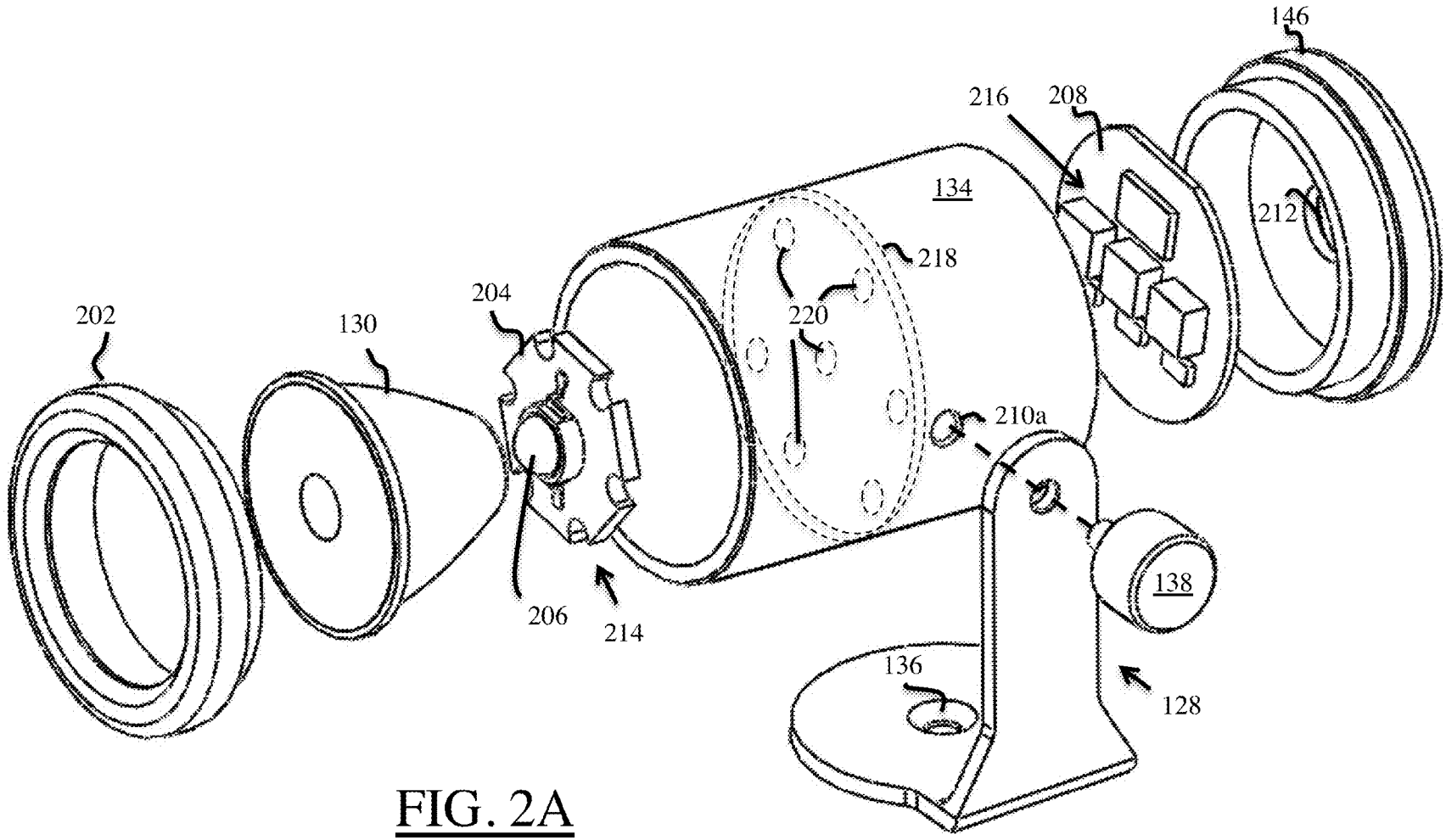
FIGS. 2A to 2C are non-limiting, exemplary illustrations that detail an intelligent micro-spotlight in accordance with an embodiment of the present invention.
Figure 2B:
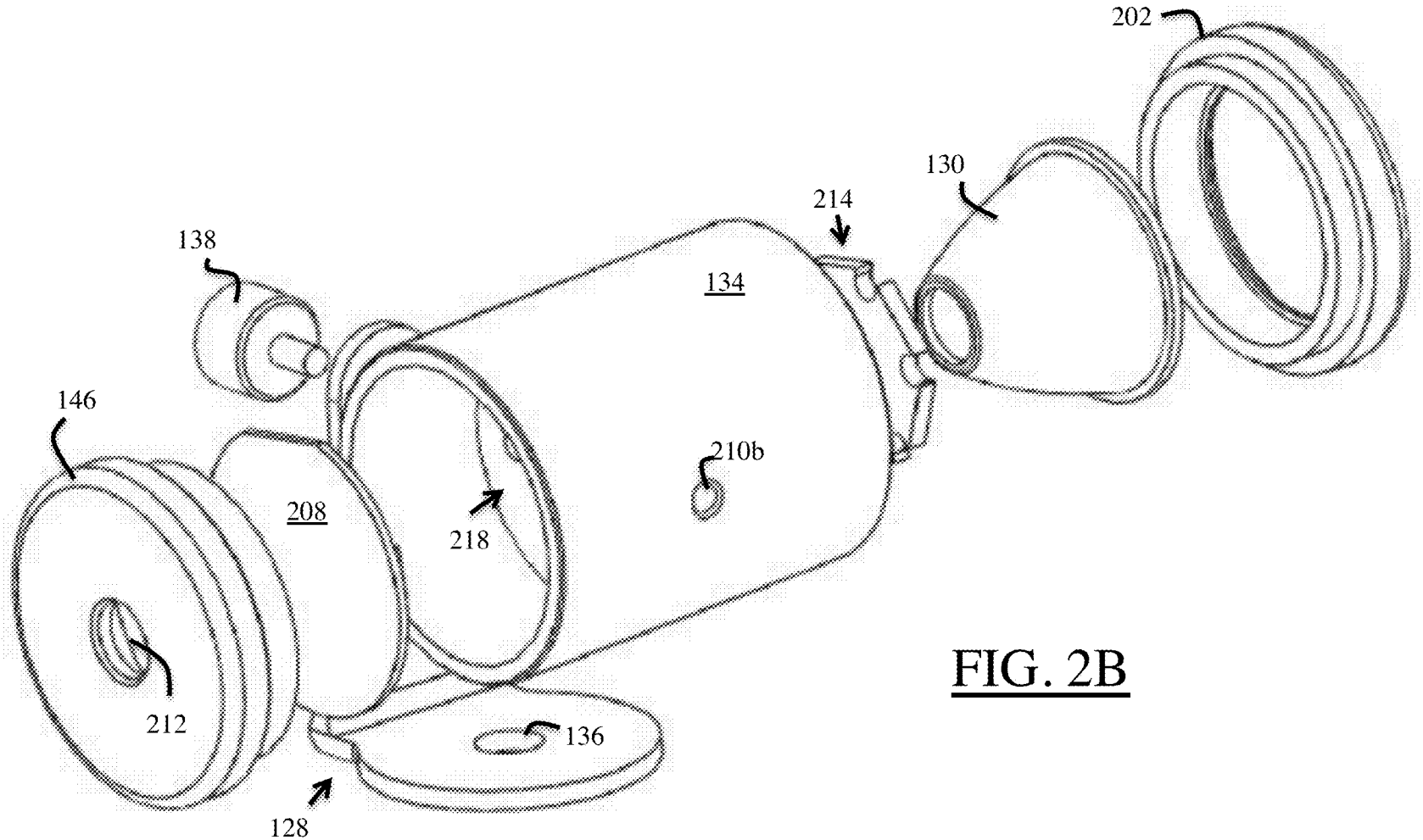
Figure 2C:
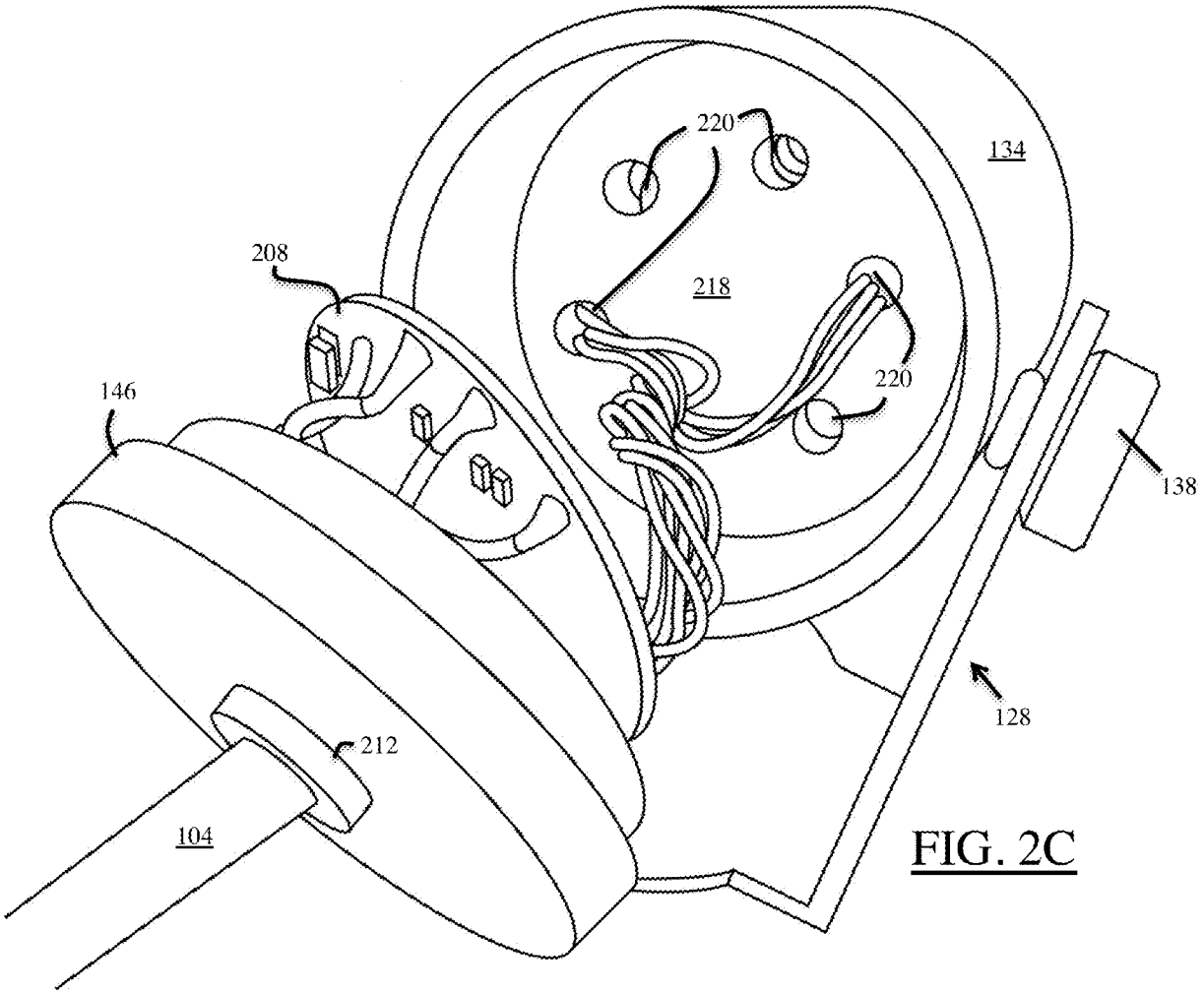

FIGS. 2A to 2C are non-limiting, exemplary illustrations that detail an intelligent micro-spotlight in accordance with an embodiment of the present invention. The intelligent micro-spotlight 102 illustrated in FIGS. 2A to 2C includes similar corresponding or equivalent components, interconnections, functional, and or cooperative relationships as the an intelligent micro-spotlight 102 that is shown in FIGS. 1A to 1B, and described above. Therefore, for the sake of brevity, clarity, convenience, and to avoid duplication, the general description of FIGS. 2A to 2C will not repeat every corresponding or equivalent component, interconnections, functional, and or cooperative relationships that has already been described above in relation to an intelligent micro-spotlight 102 that is shown in FIGS. 1A to 1B.

As illustrated in FIGS. 1A to 2C, an intelligent micro-spotlight 102 includes a light source 206 and a control circuit 216 for receiving signals and power, with the control circuit 216 having intelligence plus light source drivers that are required to power and operate (modulate) the light source 206. The light source 206 may comprise of one or more Light Emitting Diodes (LED), and the control circuit 216 may be mounted on a Printed Circuit Board (PCB) 208.

As further illustrated, the intelligent micro-spotlight 102 may optionally include a mounting stand 128 for securing the intelligent micro-spotlight 102 onto a structure. The mounting stand 128 includes a fastening aperture 136 for insertion of a fastener for securing the mounting stand 128 onto a structure, and a pivot knob 138 that detachably couples the mounting stand 128 with a hole 210 on a housing 134 of intelligent micro-spotlight housing 102, and enables the intelligent micro-spotlight 102 to pivot to desired orientation.

The intelligent micro-spotlight 102 is comprised of the housing 134 (which also functions as a heat-sink) that accommodates a lens 130, light source (one or more LEDs) 206, and the control circuit 216 mounted on the PCB 208. The housing 134 is enclosed at the front end by a front cap 202 for containing the lens 130 and the light source 206. The housing 134 is enclosed at the back end by an end cap 146 for containing the PCB 208 with the mounted control circuit 216. As illustrated, the end cap 146 includes a hole 212 for passage of the cable 104 for delivery of power and signal.

As further illustrated, the housing 134 includes a partition wall 218 that is comprised of a first and second partition sides with one or more through-holes 220. The partition wall 218 is positioned within the housing 134, providing sufficient depth to longitudinally accommodate the lens 130 and acts as a substrate to conduct heat away from components with high heat output such as the light source module 214 and electrical components on the PCB 208. The first partition side accommodates the light source 206 and the second partition side accommodates the PCB 208. The one or more through-holes 220 allow wiring from the control circuit 216 to pass and couple with the light source 206. The light source 206 is secured to the housing 134 (partition 218) by a light source mounting base 204 that dissipates heat from the light source 206 and enables the light source 206 to be secured within the housing 134, forming the light source module 214. The housing 134 has a non-limiting, substantially cylindrical configuration, but may take on any other shape and may include outer serrations to increase surface area for more efficient heat dissipation and therefore, efficient cooling.

Figure 3A:
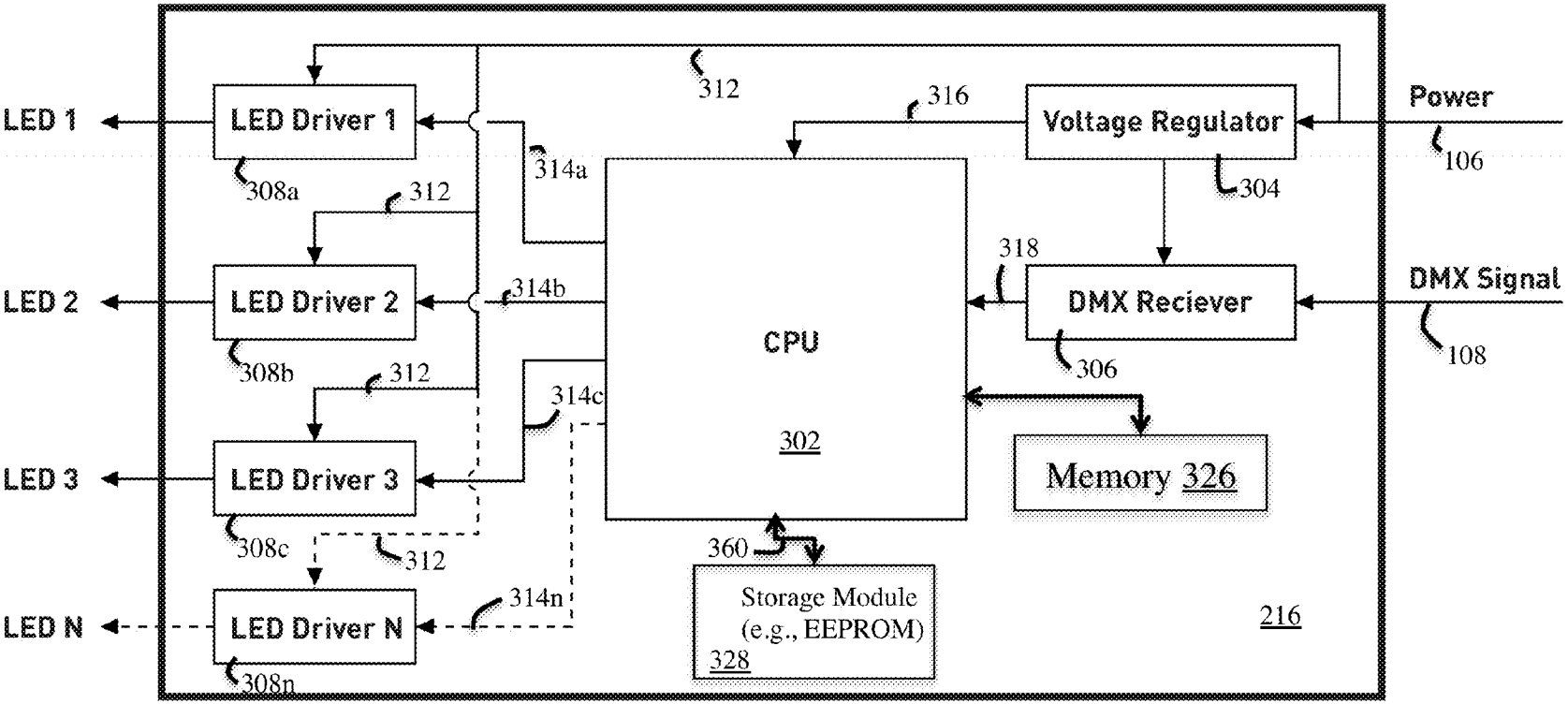
FIGS. 3A and 3B are non-limiting, exemplary block-diagram illustrations that detail a circuit topography of a control circuit of an intelligent micro-spotlight (or an intermediary module) in accordance with an embodiment of the present invention.
Figure 3B:
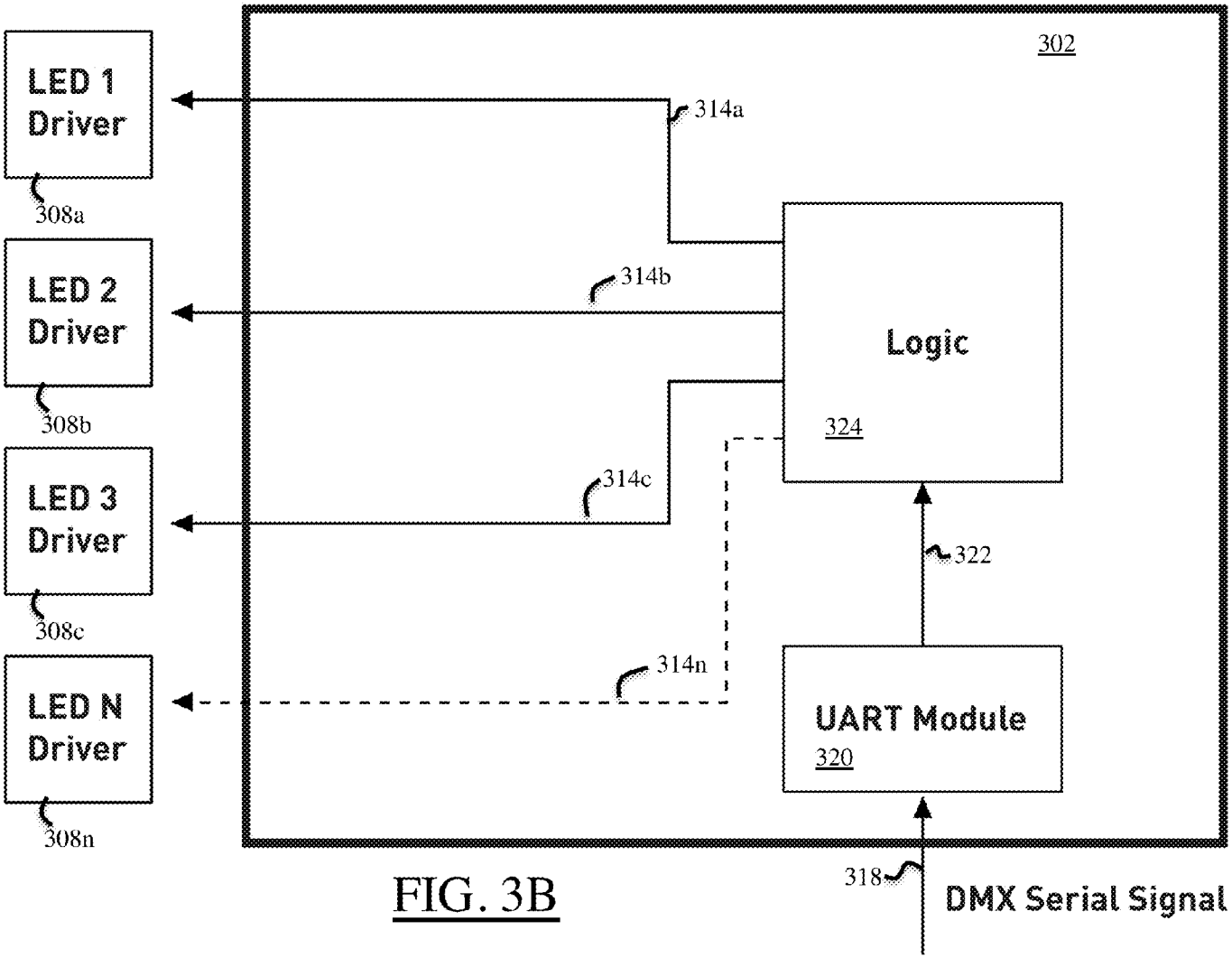
Figure 3C:
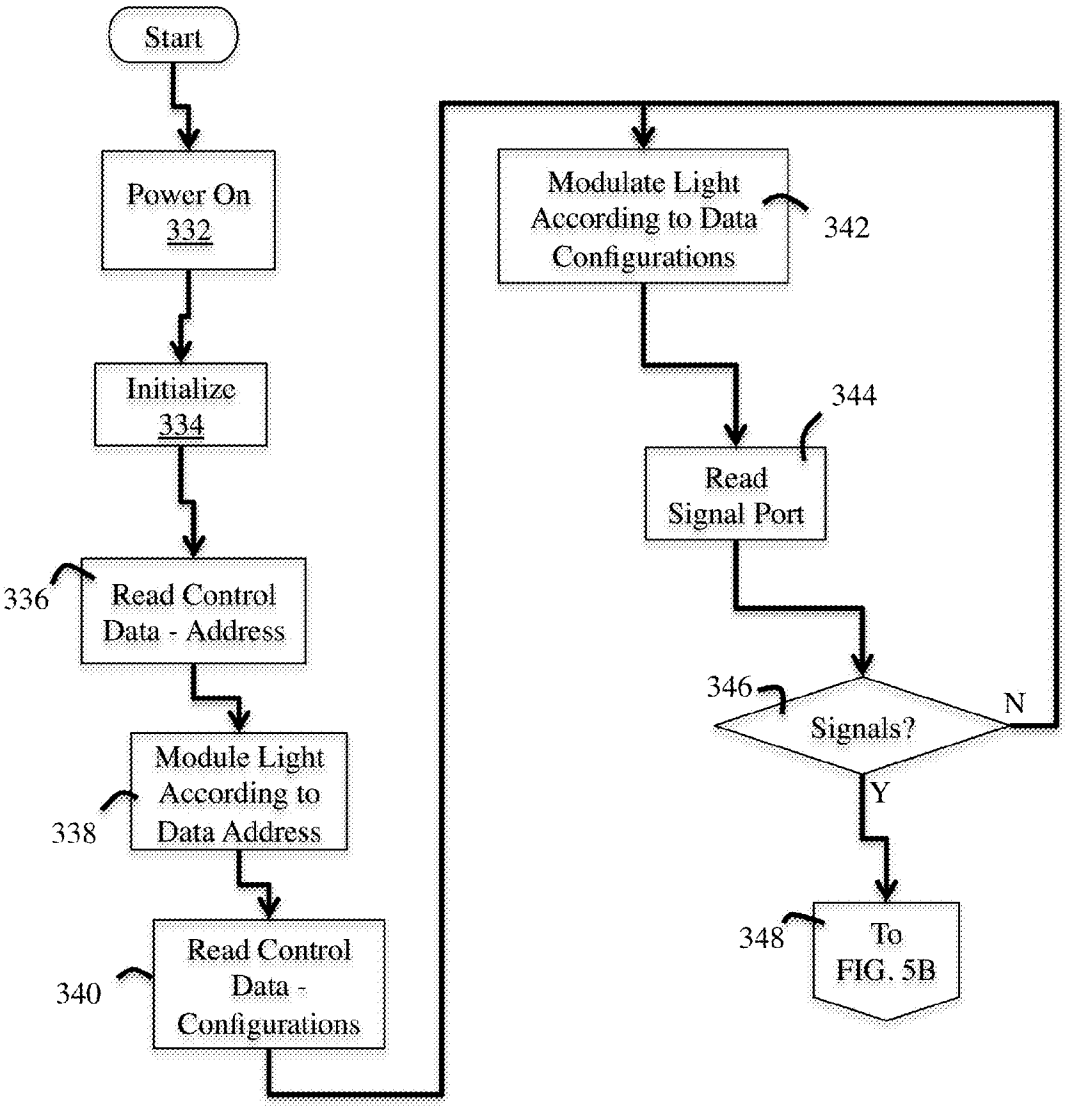
FIG. 3C is a non-limiting, exemplary flowchart, which illustrates processing of signals and power by the control circuit of the intelligent micro-spotlight and an intermediary module in a standalone operation in accordance with the present invention.
Figure 3D:
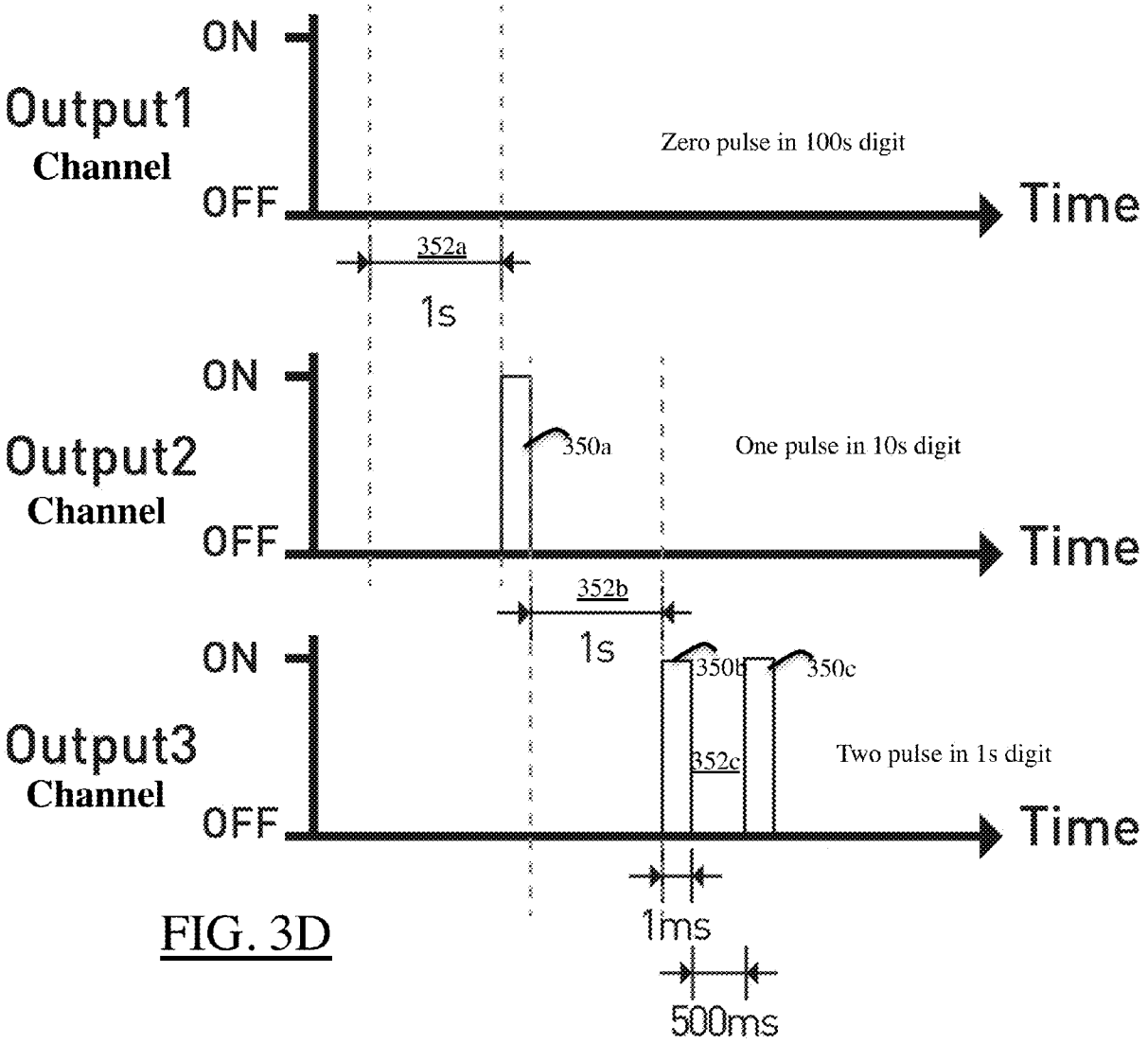
FIG. 3D is a non-limiting, exemplary graph that represent output light modulations associated with confirmation feedback responses of received power and signals by the intelligent micro-spotlight (for example, address)

FIGS. 3A and 3B are non-limiting, exemplary block-diagram illustrations that detail a circuit topography of a control circuit of an intelligent micro-spotlight in accordance with an embodiment of the present invention. FIG. 3C is a non-limiting, exemplary flowchart, which illustrates processing of signals and power by the control circuit of the intelligent micro-spotlight in a standalone operation in accordance with the present invention, and FIG. 3D is a non-limiting, exemplary graph that represent output light modulations associated with confirmation feedback responses of received power and signals by the intelligent micro-spotlight (for example, address). It should be noted that the operational functional acts illustrated in FIG. 3C and the graphical representation of the light modulations represented in FIG. 3D illustrate an already pre-preprogrammed intelligent micro-spotlight in standalone operation.

As illustrated in FIGS. 3A and 3B, the control circuit 216 of the intelligent micro-spotlight 102 is comprised of Central Processing Unit (CPU) 302 for processing of power and configuration signals (detailed below). The control circuit 216 further includes storage module 328 and memory 326, which may comprise a Read Only, Random Access, Volatile, and or Non-Volatile memory for storage of applications and instructions. A voltage regulator 304 of the control circuit 216 receives power from the power cable 106 and provides regulated voltage (step-down voltage) 316 to the CPU 302.

Further included in the control circuit 216 is a signal receiver 306 (e.g., a DMX receiver) that receives control signal from the signal cable 108 and provides logic level signal 318 to the CPU 302. It should be noted that signal 108 is typically higher voltage and using multiple (differential) lines (D+ and D−) such as using the RS485 standard to overcome transmission noise whereas signal 318 is a single logic level signal. The DMX receiver 306 does a conversion of signal format and shifts the voltage. The signal receiver 306 and its functionality are well known, and may be compatible with any control protocol used and need not be limited to DMX. It should be noted that the signal cable 108 is illustrated in FIG. 3A for completeness and discussion in view of programming the intelligent micro-spotlight 102 (detailed below), but would not be required when the intelligent micro-spotlight 102 is already programmed and in use in standalone operation. The control circuit 216 also includes one or more light source driver modules 308 that receive power (PCB power lines 312) from the power cable 106 and processed signals (PCB signal lines 314) from the CPU 302 to power and operate (modulate) one or more light sources 206.

As best illustrated in FIG. 3B, the CPU 302 is comprised of a Universal Asynchronous Receiver Transmitter (UART) module 320 for receiving programming control signal 318, and a Logic Unit 324 for decoding received serial signal 322 from the UART module 320 and for outputting one or more processed signals 314 for operation of one or more light sources 206.

As indicated above, if in standalone operation, the control signals 360 would be retrieved and read by the CPU 302 from storage modules 328 as preprogrammed, stored data, and if used in a non-standalone operation (where the intelligent micro-spotlight 102 is being programmed or controlled, which is detailed below), the programming control signal 318 would be used. It should be noted that the processed signals 314 for modulating the light sources are optionally Pulse Width Modulation (PWM) signals for operation (modulation) of the one or more light source driver modules 308. The processed signals 314 may be simple ON/OFF signals or other modulation signals (such as Bit Angle Modulation) or analog control signals and need not be Pulse Width Modulated and further, the PWM may be implemented in hardware or software. It should be noted that the main advantage of for using Bit Angle Modulation (if used) is that it takes less processing power to obtain the dimming function, allowing the use of lower cost (and smaller) CPU chips.

As indicated above, FIG. 3C is a flowchart, which illustrates processing of signals and power by the control circuit of the intelligent micro-spotlight in a standalone operation, with FIG. 3D graphically representing output light modulations associated with confirmation feedback responses of read power and signals by the CPU of the intelligent micro-spotlight (for example, address). As further indicated above, the operational functional acts illustrated in FIG. 3C and the graphical representations of the light modulations represented in FIG. 3D both illustrate an already preprogrammed intelligent micro-spotlight.

In standalone operation, the intelligent micro-spotlight 102 is capable of a default (preprogrammed) output so that it can operate without an active control signal (e.g., DMX signal). Once the desired output is configured using a programming device 414 (detailed below), only power needs to be applied to the intelligent micro-spotlight 102 and the intelligent micro-spotlight 102 will output according to its configuration upon startup. Any built-in effect (such as constant color, chase, flicker, blink, fading, or any other combinations, etc.) is achievable as a default (or preprogrammed) output. As indicated above, the standalone operation is useful when there is no access to a control console (e.g., DMX console). Further, standalone operation is also useful in that the intelligent micro-spotlight 102 may be used for displays, events, centerpieces, and mobile applications without requiring additional wiring for control signals. For portability, the intelligent micro-spotlight 102 in the standalone operation can be connected to a battery pack (FIG. 1C) and become a mobile tunable light fixture.

Referring to FIG. 3C, the processing of the control signals by the CPU 302 is commenced at the operational functional act 332 when the intelligent micro-spotlight 102 is powered ON, which may be accomplished by connection of the power branch cable 106 of the cable 104 to a power source (wall adapter or battery pack). This connection provides power to the CPU 302 to commence initialization at the operational functional act 334. At the operational functional act 334, the CPU 302 initializes its setting, non-limiting examples of which may include initializing of clock speed, I/O ports, Serial Interface for reception of control signal (e.g., DMX signal), etc.

After initialization, at the operational functional act 336, the CPU 302 retrieves and reads control data related to a start address associated with the intelligent micro-spotlight 102. For example, the CPU 302 may retrieve stored address data (e.g., represented by the signal 360) from a storage module 328 implemented as a non-limiting, exemplary Electrically Erasable Programmable Read Only Memory (EEPROM) table to determine the value (or data) of current address (e.g., a DMX address) of the intelligent micro-spotlight 102.

As has been indicated above, the intelligent micro-spotlight 102 integrated control system includes a user interface that utilizes light modulations from the integrated light source 206 of the intelligent micro-spotlight 102 as an output for confirmation of the assigned address and control configurations. That is, the intelligent micro-spotlight 102 light source 206 itself is used as an output mechanism to output a precise indication of the various exact settings (address and or control configurations). That is, the light from the lighting fixture itself is used as the output portion of the user interface to provide a visual indication as a confirmation feedback response of the assigned address and or configurations. This means that the lighting fixture itself conveys an output response in terms of the set address and control configurations received, providing a visual response confirmation of the exact address and control configurations. To this end, at the operational functional act 336, the CPU 302 of the present invention retrieves control address data from the storage module 328, and modulates light source 206 in accordance with the retrieved control address data.

FIG. 3D graphically represents output light modulations associated with confirmation feedback responses of retrieved signals by the CPU 302 of the intelligent micro-spotlight 102 (for example, control data—address). In the non-limiting, exemplary instance demonstrated in FIG. 3D, when the operational functional act 338 is executed, the light source 206 is modulated in accordance with the illustrated pulses, which visually indicate and represent the DMX address of the light fixture. In the exemplary instance of FIG. 3D (detailed below), the output light pulses represent the DMX address "012." In other words, as illustrated in FIG. 3D, the present invention uses one or more optical outputs pulsing a base 10 numerical system representation of the programmed address or configuration for compact and simple visual feedback.

At operational functional act 338, the CPU 302 executes stored data (control protocol such as a DMX address) and modulates light source 206 to provide a responsive feedback for confirmation of the assigned address and control configurations. If the control and addressing scheme used is the well-known and conventional DMX512 with 512 addresses, then the present invention may be adapted to provide a mechanism to allow indication of hundreds (100s), tens (10s), and ones (1s) digit place for the 512 DMX addresses. Therefore, arbitrarily and without limitations and for discussion purposes only, the present invention has assigned hundreds (100s) digit position and a first color of light (e.g., a red color LED light output) to a first channel output for indication of the hundreds digit position for the three digit addressing scheme of the DMX addressing protocol, tens (10s) digit position and a second color of light (e.g., green color LED light output) is assigned to a second channel output for indication of the tens digit position of the DMX address, and ones (1s) digit position and a third color of light (e.g., blue color LED light output) is assigned to the third output for indication of the ones digit position of the DMX address. Therefore output light pulses according to DMX address (operational functional act 338) shown in FIG. 3D indicate the DMX start address "012." That is, the first output (the red color light) is zero with no pulses indicating a zero—(0) for the hundreds digit position of the DMX address "012" for the first channel output with a delay 352*a* of one second prior to a commencement of the second channel output. It should be noted that even though the output for the hundreds digit is zero—(0), this value still causes the output to pause for the zero—(0) digit for a delay 352*a*.

The second channel output (the green color light) is indicated as pulsing only once (pulse 350*a*) indicating the number one—(1) in the tens digit position in the DMX address "012," where after a second delay 352*b*, the users sees two pulses (350*b* and 350*c*) of blue color light with an intra-delay of 352*c* indicating the number two—(2) in the ones digit position in the DMX address "012." Therefore, in this particular instance, the no blinking of red light and blinking of one green light and two blue lights indicate a DMX start address of "012." Accordingly, by associating specific colors to 100s, 10s, and 1s of a three digit addressing protocol such as a DMX512, and counting the number of specific colored pulses 350 in each of the channel outputs that represent the value of the digit number in 100s, 10s, and 1s, a user can easily and quickly receive a feedback confirmation of the exact set DMX address.

It should be noted that a single color or any number or combinations of modulations of one or more light sources may be used to associate with and distinguish the digits in an address scheme (e.g., DMX512). For example, although it is preferred to use different colors to indicate different channels, which facilitates and provides a visual aid in the separation of the channels, if the same color light is used for all digits, then the delay of pulses between different channel outputs and the intra-delay of pulses within the same channel should be substantially longer to visibly enable a user to count the number of pulsed lights. In fact, even if different colors are used for channels, it is preferred to have a significant delay between the pulses so to facilitate color distinction and counting of pulses by the human eye. If the pulses are spaced out to close, the human eye may not be able to recognize or count them. In other words, the delay between pulses must be noticeable so to enable the user to distinguish the channels and count each pulse within the channel. Stated otherwise, the time delay between pulses is just another method of facilitating human comprehension of confirmation of settings by the intelligent micro-spotlight 102.

Other confirmation schemes may include associating modulation of a light source to generate flicker, blinking, and constant color pulse with the respective 100s, 10s, and 1s digit position of an address scheme. It should be emphasized that it is only for convenience of example that DMX512 addressing scheme is used, which uses a three-digit address. Other addressing schemes may use more than three digits and may require four—(4), five—(5), or any number of channels, with each channel representing a digit position of the address. It should be noted that the numbering system (decimal vs. others such as octal or hexadecimal) is arbitrary and is used for convenience only.

Regardless, as indicated in FIG. 3D, the intelligent micro-spotlight 102 easily provides confirmation of address information despite its small form factor with no display for feedback, even if it is installed far above a stage or positioned in a location not accessible. Referring back to FIG. 3C, after modulation of the light according to the data address, the CPU 302 at the operational functional act 340 reads and determines the control data in relation to the actual configuration of the intelligent micro-spotlight 102. That is, the CPU 302 at the operational functional act 340 retrieves stored configuration data (as signal 360) from the storage module 328 related to the attributes of mode of operation of light source, non-limiting examples of which may include data signals for operating the intelligent micro-spotlight 102 to output an amber color, flickering light resembling a flickering candle, generating a fade in/out orange color light, or any other modes of operations. At operational functional act 342, the CPU 302 executes the retrieved control signal (e.g., signal 360), and modulates the light source 206 according to the configurations data. That is, the CPU 302 modulates the LED driver modules 308 to operate the light source 206 in accordance with the attributes (data values) associated with the mode of operation. At this point, by simply powering ON the intelligent micro-spotlight 102, the user has easily determined its address in accordance with the output pulses, and has also determined the configuration or mode of operation of the light fixture by its output at the operational functional act 342. In other words, the intelligent micro-spotlight 102 with its integrated control system uses light modulations from the lighting fixture as an output for confirmation of the assigned address and control configurations without requiring dedicated display for reading and confirmation of such settings.

As further illustrated in FIG. 3C, the CPU 302 at the operational functional act 344 continues to read and look for any incoming signal at its various ports, including signals from the UART 320. That is, the CPU 302 at the operational functional act 344 determines if an incoming signal 318 is received at the signal port from the signal receiver 306 via the signal line 108. It should be noted that in order to set the intelligent micro-spotlight 102 for standalone operation, it must obviously be programmed.

Figure 4A:
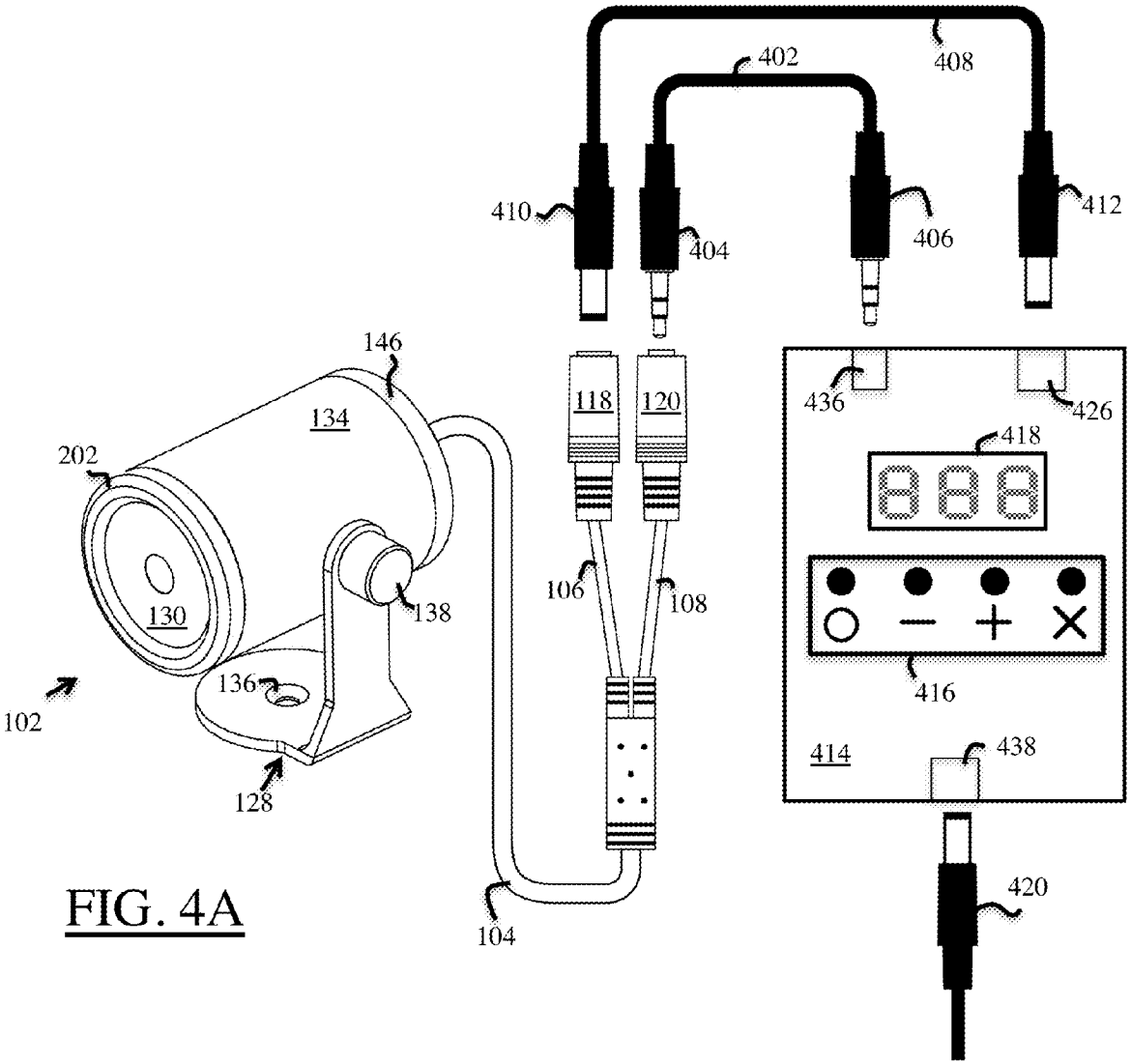
FIG. 4A is a non-limiting, exemplary illustration of a programming device that is used to program and or control an external device in accordance with an embodiment of the present invention.
Figure 4B:
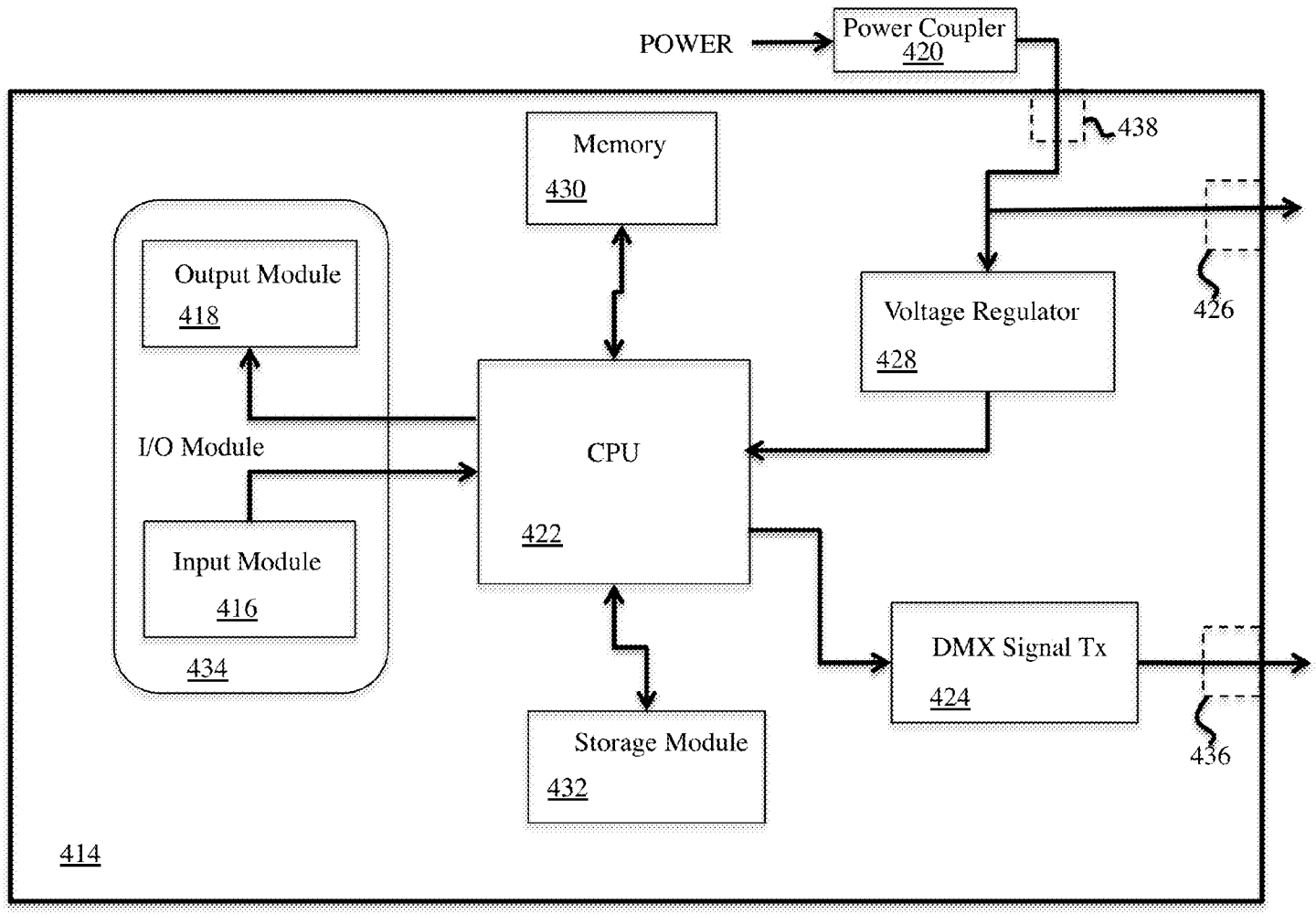
FIG. 4B is non-limiting, exemplary block diagram of the programming device illustrated in FIG. 4A, showing the various components in blocks.

FIG. 4A is a non-limiting, exemplary illustration of a programming device that is used to program and or control an external device in accordance with the present invention, and FIG. 4B is non-limiting, exemplary block diagram of the programming device illustrated in FIG. 4A, showing the various components in blocks. As illustrated in FIGS. 4A and 4B, the programming device 414 is used for programming and or controlling an external device and is illustrated as an individual unit 414. However, the programming device 414 may be implemented in a number of different manners too numerous to mention individually, non-limiting examples of which may include implementing its operation and function within a conventional computing device such as a mobile computing device (e.g., a cell phone or a laptop). Accordingly, it is only for clarity and discussion purposes that the programming device 414 is illustrated as an individual, standalone device.

As with most computing devices (mobile devices, laptops, etc.), the programming device 414 includes a user interface comprised of an input and output module 434 (I/O module). The I/O module 434 may comprise of any type of input and or output mechanism and in fact, if the device is implemented within a computing device (e.g., a mobile phone), the I/O module 434 may be the I/O module of the computing device itself, such as a touch screen of a mobile phone or a tablet. Of course, even if used as illustrated in FIGS. 4A and 4B, the I/O module 434 of the programming device 414 may be implemented external the programming device 414 and need not be an integral component thereof. For example, the programming device 414 may be coupled with a computing device (e.g., a mobile phone) that uses the I/O module of the computing device external the programming device 414. Regardless, the input module 416 is used for inputting values for desired configuration of the external device, and the output module 418 is used for displaying information for settings and configurations for the external device. Further included is a Central Processing Unit (CPU) 422 that is powered by a voltage regulator 428, with the CPU 422 receiving input from the input module 416 and displaying processed signals to the output module 418, including outputting to Signal Transmitter 424 (e.g., a DMX Signal Transmitter Tx). The programming device 414 (as with any other computing device) also includes a storage module 432 and memory 430 coupled with the CPU 422. The power input terminal 438 of the programming device 414 receives power via an input DC power jack from a power connector 420, with a power output terminal 426 providing power to an external device. The power from the power input terminal 438 is used to power the programming device 414 and is directly coupled with the power output terminal 426 to directly power an externally coupled device (e.g., an intelligent micro-spotlight 102). The direct coupling of power input 438 and power output 426 eliminates the need for a separate power supply to power the external device.

As indicated above, the programming device 414 is used for programming and configuring an externally coupled device such as the illustrated intelligent micro-spotlight 102. Therefore, the power output terminal 426 of the programming device 414 may be coupled with the external device via a male to male DC power jack connector 408, where a first end 412 of the connector 408 is coupled with the terminal 426 of the programming device 414 and a second end 410 couples with the power plug 118 of the external device. Upon connection of power, the external device (e.g., the micro-intelligent spotlight 102) is powered ON and commences execution of the operational functional acts 332 to 344 of FIG. 3C and FIG. 5B, and the programming device 414 commences execution of the operational functional acts 542 to 550 of FIG. 5A (detailed below).

As further illustrated, the programming device 414 also includes the signal output terminal 436 for transmission of signals (control signals—address and configurations) to the external device. The signal output terminal 436 of the programming device 414 is coupled with the external device via a signal connector 402, which may be a male to male 3.5 mm Tip Ring Sleeve—mini Jack Connector, with one end 406 coupled with the terminal 436 and the other end 404 coupled with the signal plug 120 of the intelligent micro-spotlight 102. Accordingly, the power from the programming device 414 is delivered to voltage regulator 304 of the intelligent micro-spotlight 102 via power cable 106 connected to the programming device 414 via cable 408, and signals programmed by the user via the input module 416 are transmitted by the CPU 422 of the programming device 414 via terminal 436 by the signal transmitter 424 and received by the signal receiver 306 of the intelligent micro-spotlight 102 via the signal cable 108 connected through the cable signal connector 402. Upon completed connections, the external device (e.g., the intelligent micro-spotlight 102) is ready to be programmed so that it can be configured to any desired setting and as stated above, once configured (already programmed), intelligent micro-spotlight 102 may operate in standalone mode (as detailed above) in accordance with the set values of the attributes of the various modes of operation, requiring only power.

The programming of the external device (e.g., intelligent micro-spotlight 102 or an intermediary module 604) depends on the type of protocol used (e.g., a DMX512) and is only a matter of inputting the desired settings according to the protocol. In the non-limiting exemplary instance illustrated in FIGS. 4A and 4B, the programming device 414 includes large number of modes of operations with the I/O module 434 enabling access, selection, and setting of modes of operations of the programming device 414 for configuration of the external device. The set modes of operations (after confirmation), includes settings of values (e.g., actual DMX data) for attributes (or parameter or properties such as address, color, flickering, dimming level, etc.) for a selected mode of operation. The set values define the attributes of the selected mode of operation stored in a storage module 432 of the programming device 414 (after confirmation) and transmitted to the external device. The external device also includes attributes for various modes of operation, the values of which are set by the transmitted signal from the programming device 414. The transmitted signal includes information that enables the external device to be programmed.

As has been stated above, due to the compact size of the intelligent micro-spotlight 102, there is no user interface on the unit to program its address and modes of operation. Instead, the programming device 414 is used to program the intelligent micro-spotlight 102 address and other configurations prior to use. Without any programming configuration, each intelligent micro-spotlight 102 is factory set to address 1 of a desired protocol (e.g., DMX address 1) and no output is set to be the default mode of operation.

The programming device 414 provides input module 416 with buttons that may be used to operate the programming device 414 to manually control and set address and other configurations of the intelligent micro-spotlight 102. Various combinations of buttons or individual buttons pressed may be used to change the mode of the programming device 414 and the coupled intelligent micro-spotlight 102 or set addresses and configurations (various modes of operation). For example, and without limitation, the button marked as "O" may be associated with modes of operation and pressed to change the mode of operation of the programming device 414. Holding down the "O" button may display via the output module 418 the current mode of the programming device 414. As another example, and without limitations, holding down the "O" button and pressing the "+" or "−" buttons enables the user to cycle through a mode menu, which is displayed by the output module 418. Releasing the "O" button selects the desired mode from the mode menu, and when the "X" button is pressed, the selected configuration is confirmed and transmitted to the intelligent micro-spotlight 102 via the signal transmitter 424, and received by the signal receiver 306 of the intelligent micro-spotlight 102. The selection of the "X" button confirms the selected values for the setting, which includes displaying of the desired values for the setting on the display module 418 and storage of the desired values of the setting in storage module 432 for later use, without requiring re-setting of the programming device 414.

The "−/+" buttons may be associated with a decrement/increment function that allow users to navigate by incrementing or decrementing to the next configuration, mode, or setting (e.g., if navigating through the mode menu, then the next mode may be selected by actuation of the "+ or −" buttons, if light intensity or color is to be modified (increased or decreased or color changed), then the next intensity or color may be selected by the actuation of the "+ or −" buttons, or if dimming of lights is desired, then the next level of dimming may be selected by actuation of the "+ or −", etc.).

As indicated above, the entire I/O module 434 may be completely implemented as a conventional Graphic User Interface (GUI) touch screen using a mobile computing device with completely different representations for the same concepts, aspects, functions, or features. The disclosed user interface provided throughout the disclosure is meant to be illustrative and for convenience of example only and should not be limiting. Therefore, the present invention is not limited to any particular user interface or even GUI configuration and may be implemented in a variety of different types of user interfaces. That is, any user interface representations of any concepts, aspects, functions, or features may be varied and therefore, none should be limiting. The non-limiting, non-exhaustive illustrations of the user interface used throughout the disclosure are provided only for a framework for discussion. For example, the mere act or function of navigating through a menu may be accomplished by numerous GUI configurations or representations of the concept of "menu navigation" that are too numerous to mention individually, non-exhaustive, non-limiting examples of which may include the use of the illustrated "+/−" buttons, GUI pull-down menus, individual GUI icons that are tapped, which direct users to other types of "menu" GUI, a simple list of text for selection, and etc.

Figure 5A:
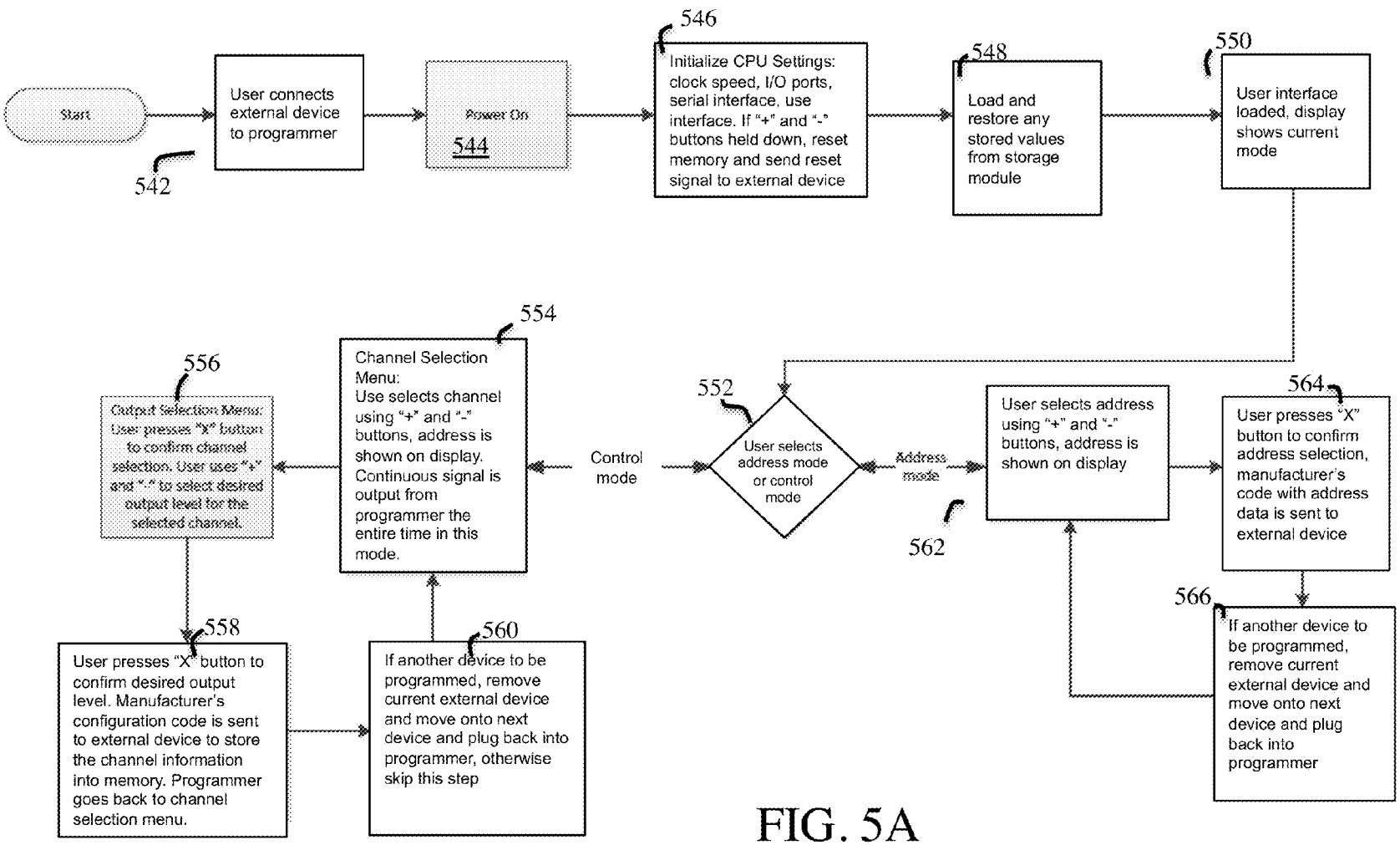
FIG. 5A is a non-limiting, exemplary flowchart, which illustrates processing of signals by the programming device, including communications with the externally coupled device in accordance with the present invention.
Figure 5B:
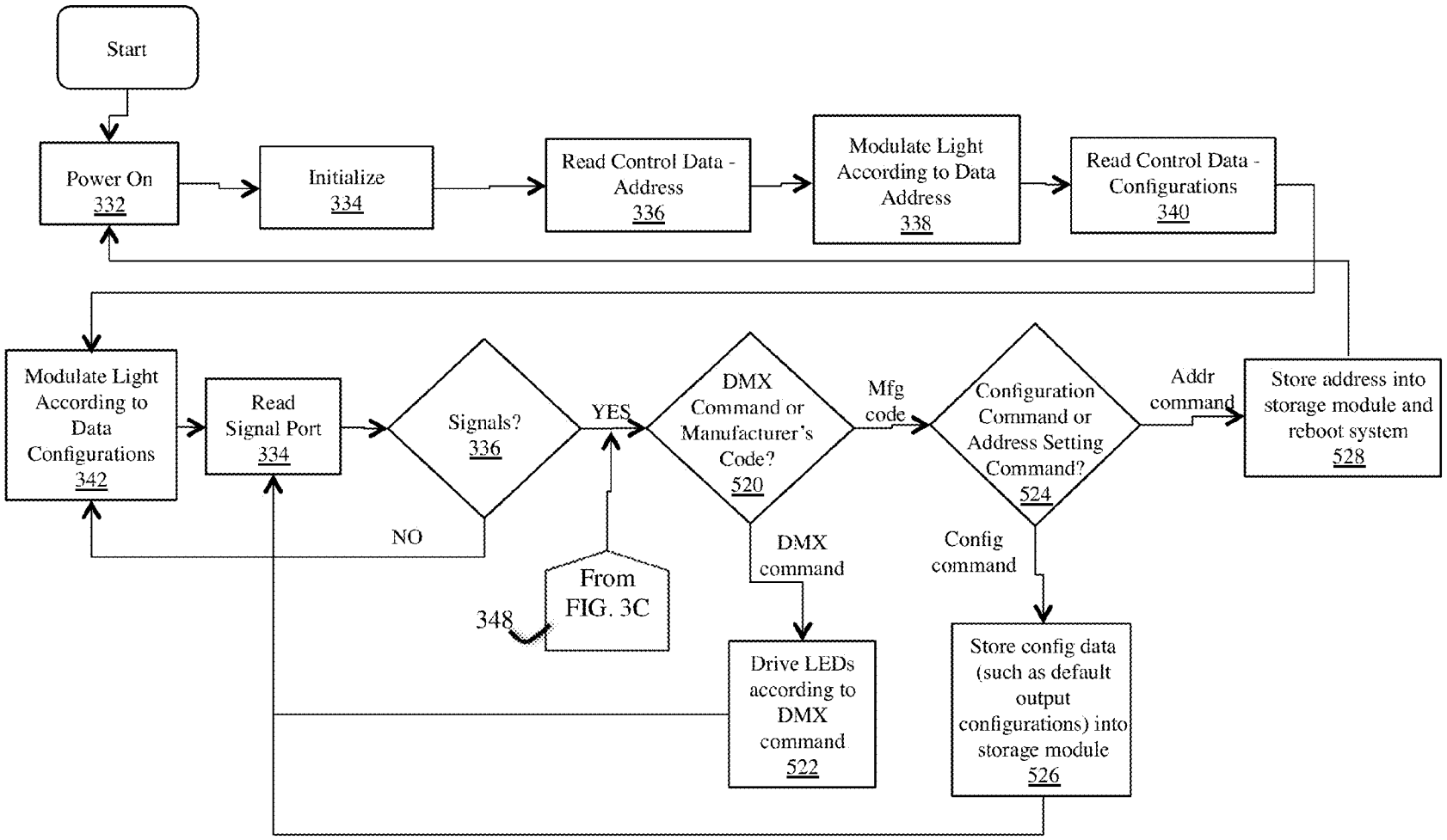
FIG. 5B is a non-limiting, exemplary flowchart, which illustrates processing of signals by the intelligent micro-spotlight or an intermediary module when coupled with the programming device in accordance with the present invention.

FIG. 5A is a non-limiting, exemplary flowchart, which illustrates processing of signals and power by the programming device, including communications with the externally coupled device in accordance with the present invention, and FIG. 5B is a non-limiting, exemplary flowchart, which illustrates processing of signals and power by intelligent micro-spotlight when coupled with the programming device or any controller (e.g., DMX console) in accordance with the present invention.

Referring to FIGS. 5A and 5B, the processing methods for programming an external device commence at the operational functional act 542 where an external device (such as the intelligent micro-spotlight 102) is connected to the programming device 414 as illustrated in FIG. 4A. At operational functional act 544 the programming device 414 is powered ON (by connecting the power plug 420 to power terminal 438). At the operational functional act 546 the CPU 422 of the programming device 414 initializes its own setting, non-limiting examples of which may include clock speed, I/O ports, Serial Interface user interface, and etc. It should be noted that at this stage, if "+" and "−" buttons are pressed together during the initialization phase, the entire programming device 414 is reset and a reset signal is also sent to the connected external device via the signal transmitter 424 to also reset the connected external device. If the external device is the intelligent micro-spotlight 102, the reset signal is received by the signal receiver 306 and is read at the operational functional act 344 (FIGS. 3C and 5B) via the UART module 320 as signal 318 to reset all parameters of the intelligent micro-spotlight 102.

As further illustrated, at operational functional act 548 the CPU 422 of the programming device 414 loads stored data from the storage module 432 to the memory 430 and restores all values from a previous programming session, and at operational functional act 550, the user interface (output module 418) is loaded with and displays current mode of operation. At operational functional act 552, the CPU 422 determines one of the many modes that may be selected by a user for programming the externally coupled device. For example, selection of address mode or control mode using the input module (e.g., by pressing the "O" button and one of "+ or –") allows for setting of address or control configurations of the attached device. It should be noted that only two modes are illustrated for simplicity, example, and discussion purposes only.

If at the operational functional act 552 the CPU 422 determines that the address mode is selected, then at operational functional act 562 the user sets the address (or start channel) of the externally coupled device via the user interface (in this case the input module, which includes the +/– buttons for setting a numeric address), which is input to the CPU 422. As with any computing device, upon entry of input, the CPU 422 receives input and outputs the selected start channel (or address) of the externally coupled device to the output module 418, where it is displayed. For example, if start channel "512" is selected, that DMX start channel value "512" shown on the output module 418.

At operational functional act 564, the CPU 422 determines if a confirmation signal is received from the input module (i.e., whether the user selects "X" to confirm the selected address). In other words, after the user inputs the numerical value of the desired address, the user may then confirm and save the address and forward the same to the externally coupled device. That is, upon receipt of confirmation from input module by the selection of "X" button, the CPU 422 forwards a manufacturers code encoded with the addressed mode code with set address via the port 436, which instructs the attached device to program itself to the received address. Further, the CPU 422 stores that same address within the storage module 432 for future use when the programming device 414 is restarted. This way, the entire programming routine need not be manually input every time the programming device 414 is rebooted. At operational functional act 566, another external device may be coupled for programming.

Referring back to the operational functional act 564 of FIG. 5A, as stated above, upon receipt of confirmation from input module by the selection of "X" button, the CPU 422 forwards manufacturers code encoded with the addressed mode code with set address by the signal transmitter 424 via the port 436 to the externally coupled device (e.g., an intelligent micro-spotlight 102). In such an instant, the CPU 302 of the intelligent micro-spotlight 102 (as the externally coupled device) receives the confirmation signal as the signal 318 via the signal receiver 306, and executes the operational functional acts 344, 346, and 520 (FIG. 5B). That is, the CPU 302 at the operational functional act 344 reads and looks for any incoming signal at its various ports, including signals from the UART 320. The CPU 302 at the operational functional act 344 determines if an incoming signal 318 is received at the signal port from the signal receiver 306 via the signal line 108. Upon receipt of the address confirmation signal from the programming device 414, the CPU 302 of the intelligent micro-spotlight 102 at the operational functional act 520 determines the type of signal received and whether the received signal 318 is a DMX command or manufacturer's code. Accordingly, upon execution of the operational functional act 564 by the CPU 422 of the programming device 414, the CPU 302 of the intelligent micro-spotlight executes operational functional act 520.

Referring back to FIG. 5A, the operational functional acts 554 and 562 may be switched quickly by mode selections at operational functional act 552 by a user. Regardless, if at the operational functional act 552 the CPU 422 determines that the users has selected the control mode, then at operational functional act 554 the user selects the desired control and while selecting, the selected address (start channel) of the attached device is shown on the display of the programming device 414. Concurrently, continuous control signals are output from the signal transmitter 424 of the programming device 414 to the external device via port 436, which signals are received by the signal receiver 306 of the intelligent micro-spotlight 102 and transmitted to the UART module 320 of the CPU 302 of the intelligent micro-spotlight 102, where the Logic Unit 324 transmits modulations signals (PWM) to the LED drivers 308 to modulate the lights (LEDs) to provide indications (live feedback confirmations) of the control configuration signals being set. Referring to FIG. 5B, the CPU 302 of the intelligent micro-spotlight receiving the signals 318 and executes the operational functional acts 520 to determine if the signal received is a command signal (e.g., a DMX command) and if so, executes the operational functional act 522 to drive the LEDs. The live feedback confirmation of the configuration of the lights enables the user to adjust settings (that is, the levels of any of the channels of the DMX commands) via the input module 416 of the programming device 414 or any other compatible controller 114 and instantaneously be provided with a visual feedback confirmation of the results of the adjustments.

At the operational functional acts 556 and 558, the CPU 422 of the programming device 414 determines the receipt of confirmation for desired channel and output levels for the channel, and upon confirmation (e.g., selection of the "X" button), the desired control configuration signal is transmitted to the intelligent micro-spotlight 102 and also saved and stored within the storage module 432. At operational functional act 560, another external device may be coupled with the programming device 414 for programming, if desired.

Referring to FIG. 5B, whether in standalone mode or coupled with a programming device 414 or controller (DMX console), the intelligent micro-spotlight 102 executes the operational functional acts 332 to 346 upon being powered to ON. If the intelligent micro-spotlight 102 is coupled with the programming device 414, and if the programming device 414 transmits a signal to the intelligent micro-spotlight 102, then the CPU 302 of the intelligent micro-spotlight 102 will execute the operational functional act 520 to determine whether the received signal is a command signal (e.g., DMX command) or a manufacturer's code. The operational functional act 520 is a well known standard method of determining DMX command versus a Manufacturer's command that may be implemented in any manner. Accordingly, determination of distinction between a DMX command and a manufacturer's code is well known and standardized that may be implemented (codified) in any manner for execution by the CPU 302. The manufacturer's code is also standardized under Entertainment Services and Technology Association (ESTA), which maintains database of alternative start codes.

If at operational functional act 520, the CPU 302 determines that the received signal is a standard DMX command, then at operational functional act 522, the CPU 302 decodes that command and modules LED lights according to the decoded DMX command. The decoding of the DMX commands are well known and conventional routines that are executed by the Logic Unit 324 of the CPU 302. The DMX command itself may be any command desired, non-limiting examples of which may include type of color for the light, its intensity, flicker, etc. After executing the command (modulating the LEDs), the CPU 302 executes the operational functional act 344 to read for more instructions. This way, the intelligent micro-spotlight 102 statuses are updated with instantaneous confirming feedback as the commands continue to be transmitted from the programming device 414.

If at operational functional act 520 the CPU 302 of the intelligent micro-spotlight 102 determined that the received signal 318 is a manufacturer's code, then at operational functional act 524 the CPU 302 determines if the configuration code is a configuration command or a configuration address command. If at the operational functional act 524 CPU 302 determines that the configuration code is an address command, then at the operational functional act 528 the address is decoded from the signal, stored in a storage unit, and the intelligent micro-spotlight 102 is rebooted with the new address. If at the operational functional act 524 it is determined that the configuration code is a configuration command, then at the operational functional act 526 the configuration command is stored in a storage module, and the operational functional act 344 is re-executed. This way, the intelligent micro-spotlight 102 statuses are updated with instantaneous confirming feedback as the commands continue to be transmitted from the programming device 414. It should be noted that the difference between operational functional acts 522 and 526 is that operational functional act 522 does not store configurations to the storage module 328 while operational functional act 526 does store configurations to the storage module 328. The operational functional act 522 occurs in a continuous loop even without user input because control signals from the programmer 414 or other controllers 114 are transmitted continuously whereas operational functional act 526 occurs only upon user execution of operational functional block 558.

Figure 6A:
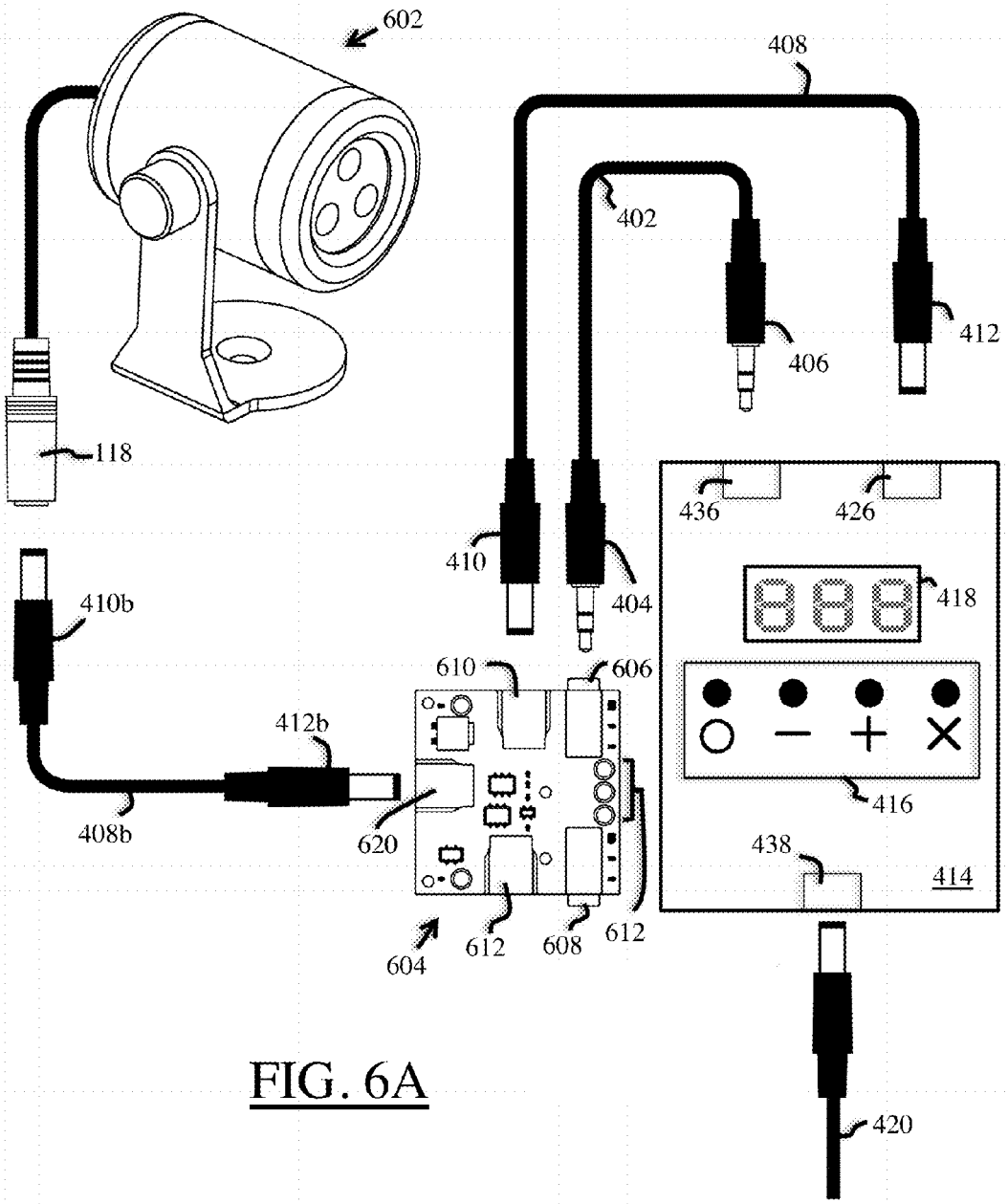
FIG. 6A is non-limiting, exemplary illustration of an intermediary module in accordance with the present invention.
Figure 6B:
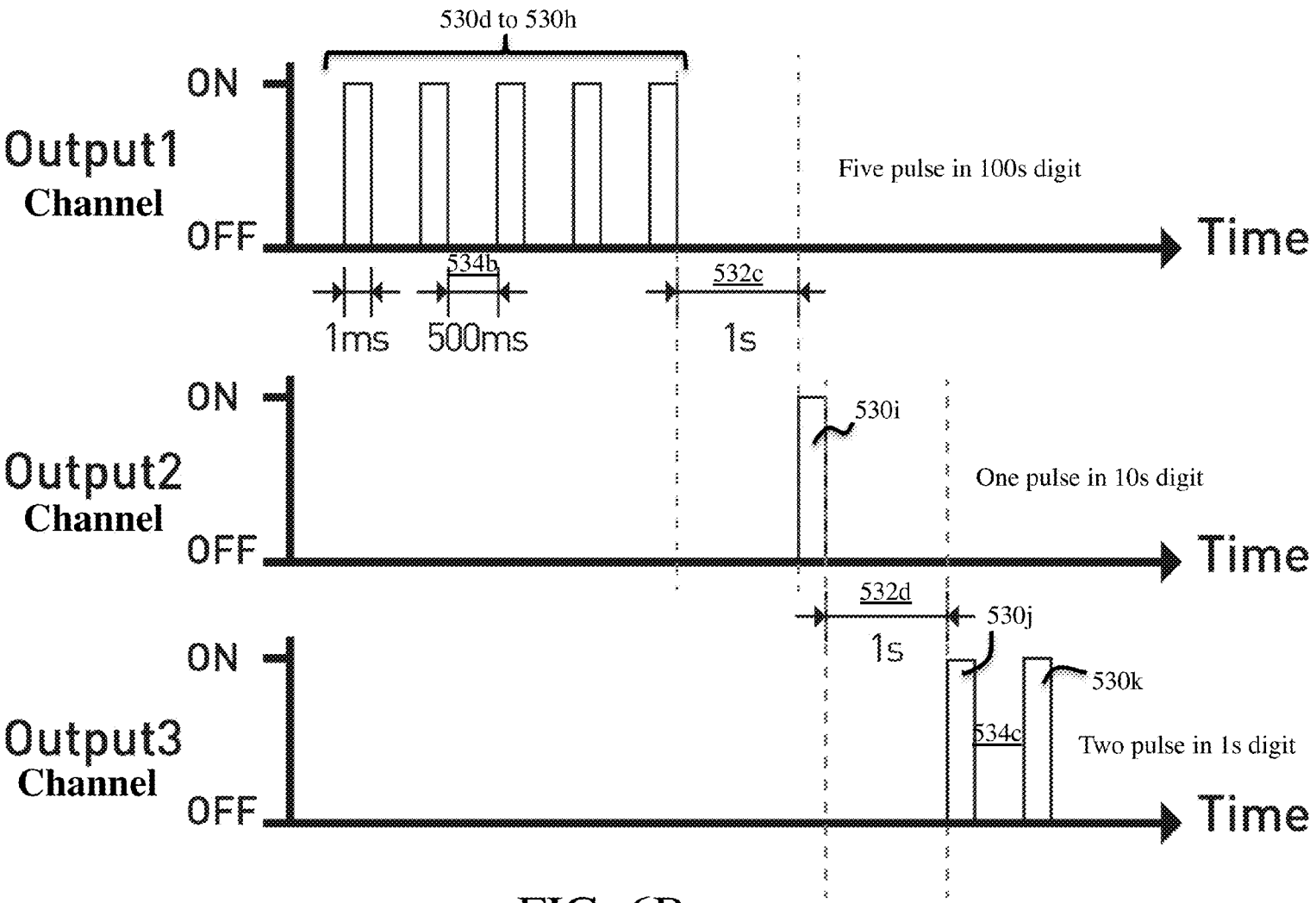
FIG. 6B is a non-limiting, exemplary graph that represents output light modulations associated with confirmation feedback responses of received signals by an intermediary module (for example, address).

FIG. 6A is a non-limiting, exemplary illustration of an intermediary module in accordance with the present invention and FIG. 6B is a non-limiting, exemplary graph that represents output light modulations associated with confirmation feedback responses of received power and signals by an intermediary module. FIGS. 6A and 6B include similar corresponding or equivalent components, interconnections, functional, and or cooperative relationships as those illustrated in FIGS. 1A to 5B and described above. Therefore, for the sake of brevity, clarity, convenience, and to avoid duplication, the general description of FIGS. 6A and 6B will not repeat every corresponding or equivalent component, interconnections, functional, and or cooperative relationships that has already been described above in relation to those illustrated in FIGS. 1A to 5B.

The present invention provides an intermediary module 604 that enables the use of any third party lighting fixture (large or small) 602 for programmed and control modulations of various configurations of the lighting fixture 602. The lighting fixture 602 may be a conventional, generic, non-intelligent micro-spotlight with the intermediary module 604 providing necessary intelligence to enable the non-intelligent micro-spotlight 602 to function as an intelligent micro-spotlight.

The intermediary module 604 includes one or more light sources 612 in a form of Light Emitting Diodes, which indicate an address of the intermediary module, indicating the hundreds, tens, and ones digit positions. It should be noted that the LED indicators are positioned on the intermediary module 612 itself because the light fixture 602 may be a very small, third party non-intelligent micro-spotlight that only has one light source or one color light source.

As further illustrated in FIG. 6A, intermediary module 604 also includes input terminals for receiving signal (signal input terminal 606) and power (power input terminal 610). Intermediary module 604 further includes output terminals for coupling signal (signal output terminal 608) and power (power output terminal 612) with a next intermediary module input terminals (606 and 610) for providing necessary intelligence to a next non-intelligent micro-spotlight light fixture to function as the intelligent micro-spotlight. This way, multiple non-intelligent micro-spotlight light fixtures 602 are controlled simultaneously and independently. That is, multiple intermediary modules 604 are stacked and have their respective I/O terminals daisy chained through the stack to control multiple non-intelligent micro-spotlight light fixtures 602 simultaneously and independently. The intermediary module 604 also includes a light fixture output terminal 620 for coupling the non-intelligent micro-spotlight light fixture 602 with the output power from the intermediary module 604.

All remaining aspects that constitute the intermediary module 604 are identical to the control circuit 216 (shown and described in relation to FIGS. 3A and 3B), with the CPU 302 of the intermediary module 604 executing one or more operational functional acts illustrated in FIGS. 3C and 5B. Accordingly, as with the intelligent micro-spotlight 102, the programming device 414 may be used for programming and configuring the intermediary module 604 (as the externally coupled device) instead of the above described and illustrated intelligent micro-spotlight 102. Therefore, the power output terminal 426 of the programming device 414 may be coupled with intermediary module 604 via a male to male DC power jack connector 408, where a first end 412 of the connector 408 is coupled with the terminal 426 of the programming device 414 and a second end 410 couples with the power input terminal 610 of the intermediary module 604. Upon connection of power, the intermediary module 604 is powered ON and commences execution of the operational functional acts 332 to 344 of FIG. 3C and FIG. 5A, and the programming device 414 commences execution of the operational functional acts 542 to 550 of FIG. 5B (detailed above).

As further illustrated, the programming device 414 also includes the signal output terminal 436 for transmission of signals (control signals—address and configurations) to the intermediary module 604. The signal output terminal 436 of the programming device 414 is coupled with the intermediary module 604 via a signal connector 402, which may be a male to male 3.5 mm Tip Ring Sleeve—mini Jack Connector, with one end 406 coupled with the terminal 436 and the other end 404 coupled with the signal input terminal 606 of the intermediary module 604. Accordingly, the power from the programming device 414 is delivered to voltage regulator 304 of the intermediary module 604 via power cable 408 connected to the programming device 414, and signals programmed by the users via the input module 416 are transmitted by the CPU 422 of the programming device 414 via terminal 436 by the signal transmitter 424 and received by the signal received 306 of the intermediary module 604 via the signal cable 402. Upon completed connections, the intermediary module 604 is ready to be programmed so that it can be configured to any desired setting and as stated above, once configured (already programmed), intermediary module 604 may operate in standalone mode (as detailed above in relation to the intelligent micro-spotlight 102) when coupled to any third party lighting fixture 602 in accordance with the set values of the attributes of the various modes of operation, requiring only power.

FIG. 6B graphically represents output light modulations of the LEDs 612 associated with confirmation feedback responses of retrieved power and signals by the CPU 302 of the intermediary module 604 (for example, control data—address). In the non-limiting, exemplary instance demonstrated in FIG. 6B, when the CPU 302 of the intermediary module 604 executes the operational functional act 338, the light sources 612 are modulated in accordance with the illustrated pulses shown in FIG. 6B, which visually indicate and represent DMX address of the light fixture 602. In the exemplary instance of FIG. 6B (detailed below), the output light pulses from the LEDs 612 represent the DMX address "512." In other words, as illustrated in FIG. 6B, the present invention uses one or more optical outputs 612 pulsing a base 10 numerical system representation of the programmed address or configuration for compact and simple visual feedback on the intermediary module 604 itself. In the instance illustrated in FIG. 6B, the first output (the red color light) has five pulses 530*d* to 530*h* indicating a five—(5) for the hundreds digit position of the DMX address "512" with a delay 532*c* of one second prior to a commencement of the second output. The second output (the green color light) pulses 530*i* only once indicating the number one—(1) in the tens digit position in the DMX address "512," where after a second delay 532*d*, the users sees two pulses 530*j* and 530*k* of blue color light from the LEDs 612 indicating the number two—(2) in the ones digit position in the DMX address "512." Accordingly, by counting the number of pulses 530 output from the LEDs 612 on the intermediary module 604 in each of the channel output colors that represent the 100s, 10s, and 1s, a user can comprehend the exact set DMX start address of the intermediary module 604 connected with the lighting fixture 602.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, although the intelligent micro-spotlight 102 is illustrated as having a substantially cylindrical configuration, it can be configured to any shape. As another example, the intermediary module 604 can have more than a single channel output (620) to control multiple channels of non-intelligent lights independently. As yet another example, multiple light sources may be used as indicator. That is, it is possible to include an independent indicator (that's not the main output source) on the back of the light fixture for confirmation of address and configurations. A further example is that cables may be replaced by power and signal ports (e.g., USB ports, XLR ports) that are directly a part of the fixture. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A control system, comprising:

a programming device to configure a micro-spot light that has no physical user interface;

the programming device includes:

a user interface comprised of:

an input and output module;

the input module for inputting configurations data for desired configuration of the micro-spot light;

an output module for displaying information for configurations for the micro-spot light;

a Central Processing Unit that receives input from the input module and displays processed signals to the output module and a signal transmitter that transmits configurations data to the micro-spot light;

wherein a visual confirmation of configurations of the micro-spot light is provided using light modulations of a light source of the micro-spot light; and wherein: the programming device is directly wire connected with the micro-spot light to establish a unidirectional communication from the programming device to the micro-spot light.

2. The control system as set forth in claim 1, wherein: setting configurations of micro-spot light includes assignment of address and control configurations.

3. The control system as set forth in claim 1, wherein: the input module enables access, selection, and setting of modes of operations of the programming device for configuration of the micro-spot light; the set modes of operations, including settings of values for attributes for a selected mode of operation, with the set values defining the attributes of the selected mode of operation stored in a storage module of the programming device and transmitted to the micro-spot light; the micro-spot light includes attributes for various modes of operation, the values of which are set by the transmitted configurations data from the programming device.

4. The control system as set forth in claim 1, wherein:

the programming device includes:

a power input terminal for receiving power via first power connector;

a power output terminal for providing power to the micro-spot light;

the power from the power input terminal is used to power the programming device and is directly coupled with the power output terminal.

5. The control system as set forth in claim 4, wherein: the power output terminal of the programming device is coupled with the micro-spot light via a second power connector.

6. The control system as set forth in claim 1, wherein: the programming device includes: signal output terminal for transmission of configuration data to the micro-spot light.

7. The control system as set forth in claim 1, wherein: the signal output terminal of the programming device is coupled with the micro-spot light via a signal connector.

8. The control system as set forth in claim 7, wherein: a configured micro-spot light operates in standalone in accordance with the set values of the attributes of the various modes of operation, requiring only power.

9. A control system, comprising:

a programming device to configure an micro-spot light, wherein the micro-spot light includes a central processing unit, a storage module, and a receiver but has no physical user interface;

the micro-spot light receives a transmitted configurations data from the programming device, and stores received configurations data within the storage module;

the programming device includes:

a user interface for input of configuration data for desired configuration of the micro-spot light and for display of configuration information;

wherein a visual confirmation of configurations of the micro-spot light is provided using light modulations of a light source of the micro-spot light in accordance with stored configurations data within storage module using the central processing unit of the micro-spot light; and wherein: the programming device is directly wire connected with the micro-spot light to establish a unidirectional communication from the programming device to the micro-spot light.

10. The control system as set forth in claim 9, wherein: when the micro-intelligent spot-light is connected with a controller device, the stored configurations of the micro-spot-light is overridden by the controller device, with light modulations of the light source of the micro-spot light providing instantaneous confirmation of configurations by the controller device.

11. A control system, comprising:

a programming device to configure an micro-spot light;

the programming device includes:

a user interface for input of configuration data for desired configuration of the micro-spot light and for display of configuration information;

the micro-spot light includes:

a receiver for receiving configuration data from the programming device;

a storage module for storing received configurations data; and a light source that is modulated in accordance with stored configurations data;

wherein a visual confirmation of configurations of the micro-spot light is provided using light modulations of the light source of the micro-spot light in accordance with stored configurations data; and wherein: the programming device is directly wire connected with the micro-spot light to establish a unidirectional communication from the programming device to the micro-spot light.

12. The control system as set forth in claim 11, wherein: the configurations of the micro-spot light is overridden instantaneously by a coupled controller device, with light modulations of the light source of the micro-spot light providing instantaneous confirmation of the configurations.

13. The control system as set forth in claim 11, wherein: the micro-spot light independently operates in accordance with the stored configurations data when detached from the programming device.

14. The control system as set forth in claim 11, wherein: the visual confirmation of configurations of the micro-spot light includes using light modulations comprised of strobes light modulations sequences at frequencies to convey 100s, 10s, and 1s of a DMX address.

15. A control system, comprising:

a programming device to configure an micro-spot light;

the programming device includes:

a user interface for input of configuration data for desired configuration of the micro-spot light and for display of configuration information;

the programming device is directly wire connected with the micro-spot light for transmission of configurations data to the micro-spot light;

the micro-spot light includes: a Central Processing Unit (CPU) for processing and storing received configurations data; a light source that is modulated in accordance with stored configurations data; wherein: a visual confirmation of configurations of the micro-spot light is provided using light modulations of the light source of the micro-spot light in accordance with stored configurations data, with a first set of light modulations comprised of strobes at a frequency indicative of an address configuration followed by a second set of light modulations indicative of control configurations; and wherein: the programming device is directly wire connected with the micro-spot light to establish a unidirectional communication from the programming device to the micro-spot light.

16. The control system as set forth in claim 15, wherein: the visual confirmation of configurations of the micro-spot light includes using light modulations comprised of strobes of light modulations sequences at frequencies to convey 100s, 10s, and 1s of a DMX address.

17. The control system as set forth in claim 15, wherein: the CPU of the micro-spot light resides on a Printed Circuit Board with a surface area less than two square inches.

18. A control system, comprising:

a programming device to configure an micro-spot light;

the programming device includes:

a user interface for input of configuration data for desired configuration of the micro-spot light and for display of configuration information;

the programming device is directly wire connected with the micro-spot light for transmission of configurations data to the micro-spot light;

the micro-spot light includes: a central processing unit for processing and storing received configuration data;

a light source that is modulated in accordance with the stored configurations data; wherein: modulations of the light source in accordance with the stored configurations data is overridden by instantaneous configuration data received from a controller device; and wherein: a visual confirmation of instantaneous configurations of the micro-spot light is provided by instantaneous light modulations of the light source of the micro-spot light in accordance with instantaneous configurations data;

and wherein: the programming device is directly wire connected with the micro-spot light to establish a unidirectional communication from the programming device to the micro-spot light.

19. A control system, comprising:

a programming device to configure an micro-spot light, wherein the micro-spot light has no physical user interface; the micro-spot light includes a receiver that receives the transmitted configurations data from the programming device and provides a visual confirmation of configurations of the micro-spot light using light modulations of a light source of the micro-spot light; and wherein: the programming device is directly wire connected with the micro-spot light to establish a unidirectional communication from the programming device to the micro-spot light.

20. The control system as set forth in claim 1, wherein: the micro-spot light is adapted to only receive, but not transmit data.

21. The control system as set forth in claim 1, wherein: the configurations of the micro-spot light modulations are overridden configurations data by instantaneous configuration data received from a controller device; and wherein: a visual confirmation of instantaneous configurations of the micro-spot light is provided by instantaneous light modulations of the light source of the micro-spot light in accordance with instantaneous configurations data.

22. The control system as set forth in claim 1, wherein: the unidirectional communication is comprised of a one-way transmission of configurations data from the programming device to the micro-spot light.

23. The control system as set forth in claim 1, wherein: the micro-spot light includes a receiver that receives the transmitted configurations data from the programming device.

24. The control system as set forth in claim 1, wherein: the light modulations include: a first set of light modulations is comprised of strobes at a frequency indicative of an address configuration followed by a second set of light modulations that are indicative of control configurations.

25. The control system as set forth in claim 24, wherein: the visual confirmation of configurations of the micro-spot light includes using light modulations comprised of strobes light modulations sequences at frequencies to convey 100s, 10s, and 1s of a DMX address.

* * * * *